US008136287B2

(12) United States Patent
Adams

(10) Patent No.: US 8,136,287 B2
(45) **Date of Patent: *Mar. 20, 2012**

(54) UNIVERSAL QUICK-RELEASE COUPLER

(76) Inventor: Steve Adams, Homer Glen, IL (US)

( * ) Notice: Subject to any disclaimer, the term of this patent is extended or adjusted under 35 U.S.C. 154(b) by 365 days.

This patent is subject to a terminal disclaimer.

(21) Appl. No.: 12/225,144

(22) PCT Filed: Mar. 16, 2007

(86) PCT No.: PCT/US2007/006729

§ 371 (c)(1),
(2), (4) Date: Sep. 15, 2008

(87) PCT Pub. No.: WO2007/109187

PCT Pub. Date: Sep. 27, 2007

(65) Prior Publication Data

US 2009/0185854 A1 Jul. 23, 2009

Related U.S. Application Data

(60) Provisional application No. 60/783,339, filed on Mar. 17, 2006, provisional application No. 60/795,927, filed on Apr. 28, 2006.

(51) Int. Cl.
*F41G 1/387* (2006.01)

(52) U.S. Cl. ..... 42/124; 42/127; 403/327; 403/325

(58) Field of Classification Search ..... 403/325, 403/327, 328; 42/124, 127
See application file for complete search history.

(56) References Cited

U.S. PATENT DOCUMENTS 2,526,816 A 10/1950 Hardgrove
2,528,080 A 10/1950 Robertson
2,539,008 A 1/1951 Brookhyser
2,580,246 A * 12/1951 Schall ..... 42/127
(Continued)

FOREIGN PATENT DOCUMENTS

DE 8909502 U1 10/1989
(Continued)

OTHER PUBLICATIONS

International Search Report and Written Opinion for PCT/US2007/06729 dated Nov. 13, 2007.

*Primary Examiner* — Joshua Kennedy
(74) *Attorney, Agent, or Firm* — Bishop & Diehl, Ltd.

(57) ABSTRACT

A coupler apparatus for releasably securing an object to a support member, is described. The mounting apparatus includes a connector joined to the object and having a tapered plug with a slot that extends inward from an outer wall of the plug. The apparatus further includes a base with an internal cavity extending between opposed side walls of the base. The base may be integral with the support member and has an aperture with an internal wall arrangement including an orifice wherein the aperture is dimensioned for reception of the plug. A keeper is slidable positioned within the internal cavity and has a finger that extends though the orifice and into the slot to retain the plug within the aperture. The apparatus is moveable between a secured position wherein the keeper finger extends through the orifice and into the slot of the plug positioned within the aperture, a released position wherein the keeper finger is disengaged from the orifice, and a detached position wherein the connector and the object are removed from the base by applying a linear lifting force.

11 Claims, 15 Drawing Sheets

U.S. PATENT DOCUMENTS

| | | | | | |
|---|---|---|---|---|---|
| 2,649,779 | A | | 8/1953 | Hardgrove et al. | |
| 2,767,473 | A | | 10/1956 | Craven | |
| 2,857,675 | A | | 10/1958 | Kesselring | |
| 2,924,881 | A | * | 2/1960 | Gee | 42/127 |
| 3,104,477 | A | * | 9/1963 | Edwill | 33/374 |
| 3,324,558 | A | | 6/1967 | Hart | |
| 3,579,840 | A | | 5/1971 | Heinzel | |
| 3,750,318 | A | | 8/1973 | Burris | |
| 3,880,389 | A | | 4/1975 | Burris | |
| 3,986,285 | A | | 10/1976 | Krisay | |
| 4,085,511 | A | | 4/1978 | Kovac | |
| 4,121,363 | A | | 10/1978 | York | |
| 4,161,076 | A | | 7/1979 | Snyder | |
| 4,168,588 | A | | 9/1979 | Snyder | |
| 4,205,473 | A | * | 6/1980 | Wilson | 42/127 |
| 4,305,266 | A | | 12/1981 | Lockwood | |
| 4,341,022 | A | | 7/1982 | Santoro | |
| 4,446,644 | A | | 5/1984 | Jimenez et al. | |
| 4,501,071 | A | | 2/1985 | Manske | |
| 4,539,769 | A | | 9/1985 | Stevens et al. | |
| 4,571,870 | A | | 2/1986 | Heideman et al. | |
| 4,707,772 | A | | 11/1987 | Jimenez et al. | |
| 4,776,126 | A | | 10/1988 | Williams | |
| 4,835,895 | A | | 6/1989 | Bowen | |
| 4,894,941 | A | | 1/1990 | Karow, Jr. | |
| 5,035,487 | A | | 7/1991 | Herz | |
| 5,144,752 | A | | 9/1992 | Boeke et al. | |
| 5,155,915 | A | | 10/1992 | Repa | |
| 5,274,941 | A | | 1/1994 | Moore | |
| 5,353,539 | A | | 10/1994 | Zeh | |
| 5,390,419 | A | | 2/1995 | Sirkis | |
| 5,428,915 | A | | 7/1995 | King | |
| 5,685,105 | A | | 11/1997 | Teetzel | |
| 5,771,622 | A | | 6/1998 | Koziuk et al. | |
| 5,787,630 | A | | 8/1998 | Martel | |
| 6,115,952 | A | | 9/2000 | Rigler | |
| 6,449,893 | B2 | | 9/2002 | Spinner | |
| 6,594,938 | B2 | * | 7/2003 | Horton | 42/127 |
| 6,629,381 | B1 | | 10/2003 | Keng | |
| 6,705,037 | B2 | | 3/2004 | Van Kirk | |
| 6,874,269 | B2 | * | 4/2005 | Chen et al. | 42/85 |
| 6,886,288 | B1 | | 5/2005 | Yocum et al. | |
| 7,444,776 | B2 | * | 11/2008 | Adams | 42/127 |
| 2003/0056417 | A1 | | 3/2003 | Horton | |
| 2004/0139644 | A1 | * | 7/2004 | Murello | 42/85 |
| 2005/0039369 | A1 | | 2/2005 | Wilson | |
| 2005/0057042 | A1 | | 3/2005 | Wicks | |
| 2006/0010758 | A1 | | 1/2006 | Zeh | |

FOREIGN PATENT DOCUMENTS

| | | | |
|---|---|---|---|
| EP | 1321221 | A1 | 6/2003 |
| GB | 752966 | | 7/1956 |
| GB | 1183187 | | 3/1970 |
| WO | WO 92/07230 | | 4/1992 |
| WO | WO 96/37749 | | 11/1996 |

* cited by examiner

FIG. 5A
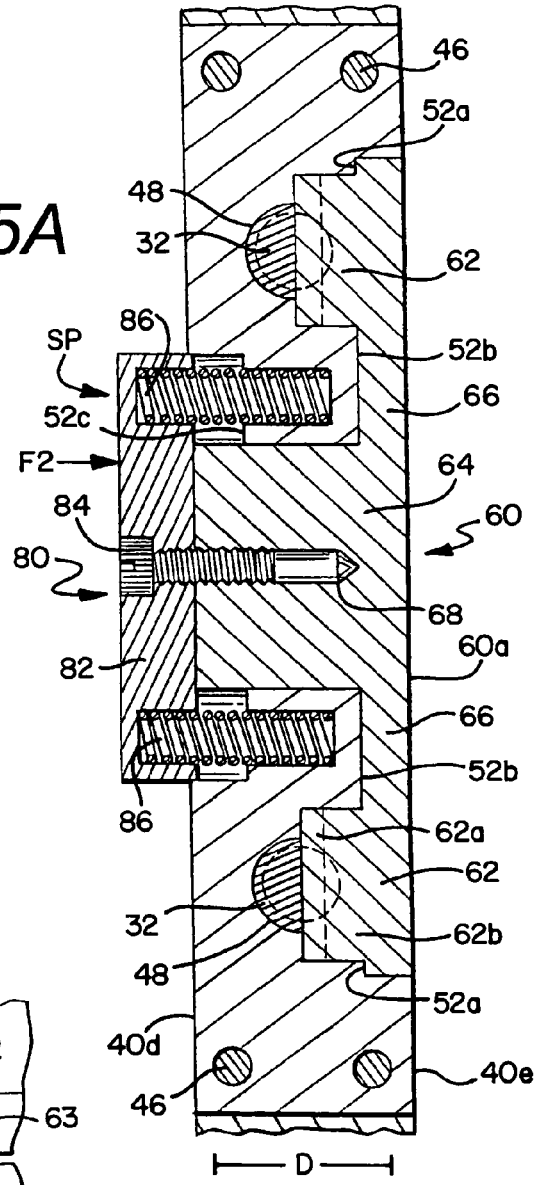
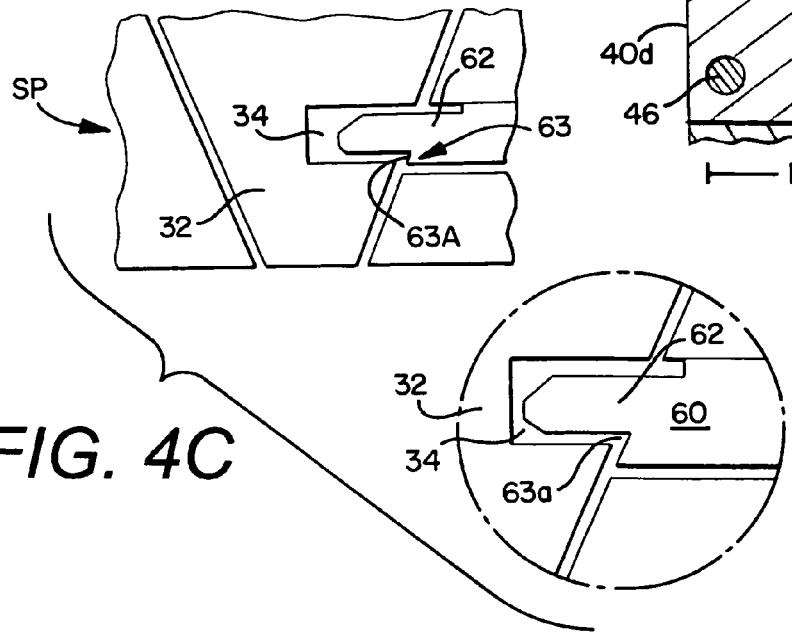
FIG. 4C

FIG. 6
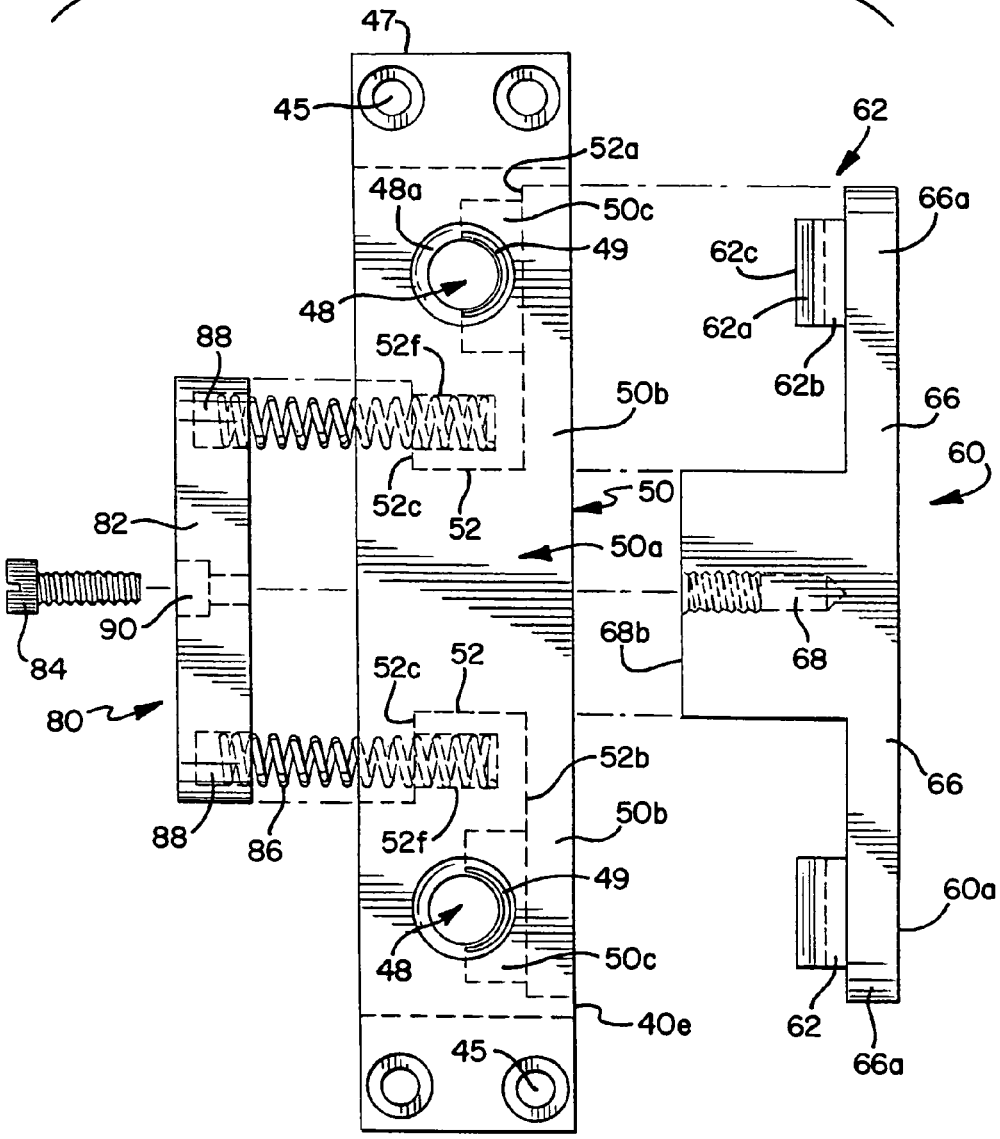
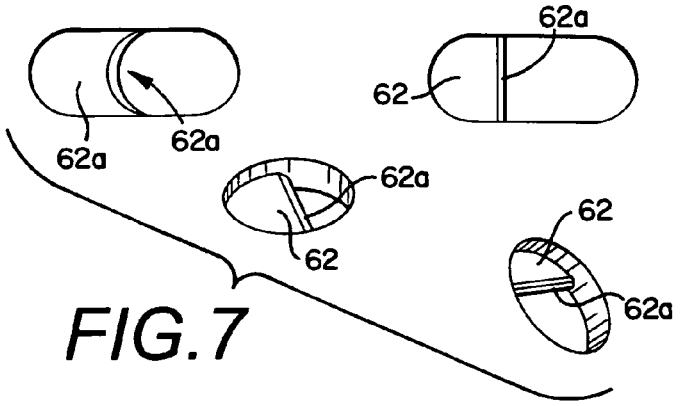
FIG.7

UNIVERSAL QUICK-RELEASE COUPLER

CROSS-REFERENCE TO RELATED APPLICATIONS

This application claims priority to International Patent Application No. PCT/US2007/006729 filed Mar. 16, 2007, which application claims priority to U.S. patent application Ser. No. 11/377,069 filed Mar. 16, 2006, U.S. Provisional Application No. 60/783,339 filed Mar. 17, 2006 and U.S. Provisional Application No. 60/795,927 filed Apr. 28, 2006, and, which applications are expressly incorporated herein by reference and made a part hereof.

FEDERALLY SPONSORED RESEARCH OR DEVELOPMENT

Not Applicable

TECHNICAL FIELD

The invention relates to a universal quick-release coupler that joins an object to a support structure. The quick-release coupler includes a base that may be integrated into the support structure and a connector that may be integrated into the item, wherein the connector is received by the base to couple the object to the support structure. The connector and the object are vertically detached from the base and the support structure without pivoting or rotational movement. The coupler may be configured as workpiece holder apparatus for a machine tool that provides for rapid interchangeability of the workpiece. Alternatively, the coupler may be configured as an accessory mounting apparatus for a firearm that provides for rapid interchange of multiple accessories to the firearm.

BACKGROUND OF THE INVENTION

There currently exists a number of coupler and connector assemblies. While such couplers and connectors provide a number of beneficial features, they nevertheless have certain limitations. Also, there currently exists a number of workpiece holders used in connection with machine tools. Workpiece holders typically include a base, which is installed in machine tool or tool station, and a fixture that receivably secures the workpiece. Conventional workpiece holders suffer from a number of problems. For example, the workpiece cannot be moved between bases with the same fixture. Thus, workpiece must be removed from a first fixture and then positioned within a second fixture, whereby the calibrations of the workpiece holder must be reset to ensure accurate positioning of the workpiece. As another example, the fixture and the workpiece cannot be quickly and easily detached from the base. As a result, the fixture and workpiece cannot be moved to other bases and/or tool stations in a timely and efficient manner. Therefore, manufacturing costs, including labor costs, are increased which in turn reduces the efficiency of the manufacturing process.

In addition, there currently exists a number of accessory mounting systems for firearms that removably secure the accessory to the firearm. Conventional mounting systems typically include an accessory interface or ring, a block that is affixed to the firearm and to which the accessory interface is secured, and a control knob or level that is actuated to connect the interface to the block. Most conventional mounting systems require angular movement, or pivoting, of the accessory and the interface for coupling with the block to secure the accessory to the firearm. The control knob or lever is then actuated to lock the accessory in place. After the control knob is re-actuated, a second pivotal movement is required to remove the interface and the accessory from the firearm. The structure of conventional mounting systems limits the utility and/or effectiveness of the system in many ways. First, the movements between a secured position and a released position can be time consuming and require the operator to use two hands. Second, the angular or pivotal movement of the accessory during insertion and removal can cause the accessory to contact the firearm, thereby limiting the dimensions of the accessory. In the context of an optical scope, flashlight, laser sights, etc., limiting the dimensions of the accessory can negatively affect its performance characteristics. Third, the actual securement of the accessory to the block requires actuation of the control knob or lever, which is time consuming and subject to wear over time. Fourth, when the accessory, such as a scope, is removed, the firearm's original sights cannot be utilized since the block is so large that it obstructs the sights. Fifth, the conventional mounting systems contain a significant number of components and moving parts that increase the complexity of operation, as well as increasing the material and manufacturing costs.

The present invention is provided to solve the problems discussed above and other problems, and to provide advantages and aspects not provided by prior holder apparatuses. A full discussion of the features and advantages of the present invention is deferred to the following detailed description, which proceeds with reference to the accompanying drawings.

SUMMARY OF THE INVENTION

The present invention is directed to a universal quick-release coupler that joins an object to a support structure. The quick-release coupler includes a base that is integrated into the support structure and a connector that is integrated into the object, wherein the connector is received by the base to rigidly couple the object to the support structure. Alternatively, the base is removably joined to the support structure and the connector is removably joined to the object. The connector and the object are vertically detached from the base and the support structure without pivoting or rotational movement, whereby the object, such as a tool, a part, or an electronic device, can be connected to another base installed on or in another support structure.

According to one aspect of the invention, the universal quick-release coupler includes unique components that enable the object to be moved between a secured position, a released position and a detached position wherein the object is removed from the base by the application of a lifting force upon the connector and/or the object. Preferably, the lifting force is a directed outward and perpendicular to the base. Once the detached position is reached, the object can be moved to a base installed in a different support structure without recalibrating the positioning of the connector with respect to object. In this manner, the apparatus allows for the rapid and precise interchangeability of objects and the movement of objects between various bases and support surfaces.

According to another aspect, the present invention is directed to a holder apparatus for releasably securing a workpiece to a tool. The holder apparatus includes a fixture that secures the workpiece and a base. The fixture and the workpiece are vertically detached from the base without pivoting or rotation, whereby the workpiece can be connected to another base installed on other machine tools or tool stations.

According to a further aspect of the invention, the mounting apparatus includes unique components that enable the workpiece to be moved between a secured position, a released position and a detached position wherein the workpiece is removed from the base by the application of a vertical lifting force upon the fixture and/or the workpiece. Once the detached position is reached, the workpiece (and the fixture) can be moved to a base installed in a different tool and/or tool station without recalibrating the positioning of the workpiece. In this manner, the apparatus allows for the rapid and precise interchangeability of workpieces and the movement of workpieces between various tools.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 4C is a schematic view of an alternate keeper finger of the coupler apparatus;

FIG. 5A is a cross-sectional view of the coupler apparatus taken along line 5-5 of FIG. 2, showing the apparatus in the secured position;

FIG. 6 is an exploded top view of the coupler apparatus;

FIG. 7 is a collection of perspective views of alternate keeper finger configurations;

DETAILED DESCRIPTION

Figure 1B:
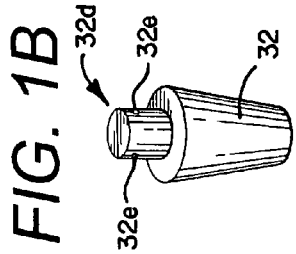
FIG. 1B is a perspective view an alternate plug of the coupler of FIG. 1.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The Figures show a universal quick-release coupler or a workpiece holder apparatus 10 for a machine tools that joins an object 14 to a support structure 18. The quick-release coupler 10 includes a connector of fixture 20 that secures the object 14 or workpiece and a base 40. The base 40 may be integrated into the support member or structure 18 and the connector 20 may be integrated into the object 14, wherein the connector 20 is received by the base 40 to couple the object 14 to the support structure 18. Alternatively, the convention is reversed whereby the base 40 is integrated into the object 14 and the connector 20 is integrated with the support structure 18. The connector 20 and the object 14 are vertically detached from the base 40 without pivoting or rotation, whereby the object 14 can be connected to another base 40 installed on another support structure 18. As explained below, the coupler system 10 includes unique components that enable the object 14 to be moved between a secured position SP, a released position RP and a detached position DP wherein the object 14 is removed from the base 40 by the application of a lifting force applied upon the connector 20 and/or the object 14 and substantially perpendicular to the base 40. Once the detached position DP is reached, the object 14 can be moved to a base installed in a different tool and/or tool station without recalibrating the positioning of the object 14. In this manner, the apparatus 10 allows for the rapid and precise interchangeability of objects 14 and the movement of object 14 between various support structures 18.

Figure 1A:
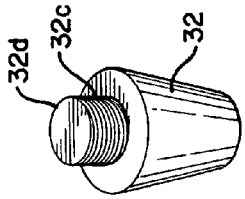
FIG. 1A is a perspective view of a plug of the coupler of FIG. 1.
Figure 1:
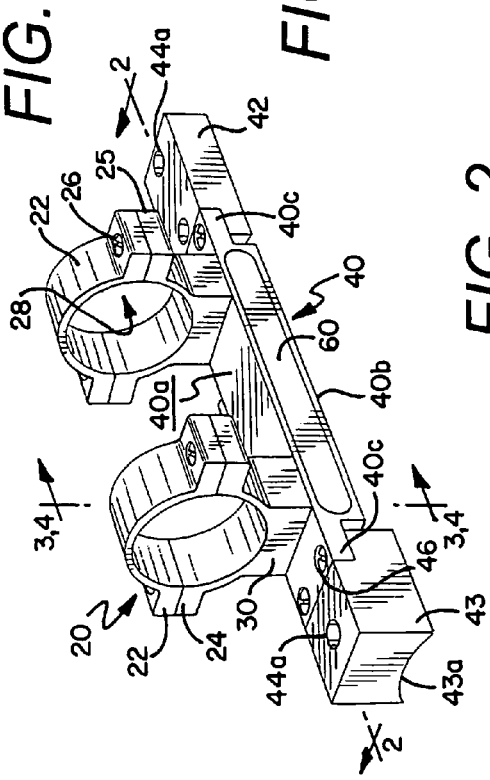
FIG. 1 is a perspective view of a quick-release coupler apparatus of the invention.

The object 14 is an item or element that requires connection or coupling to the support structure or workpiece 18. The present invention can be used for a number of applications, for example, the object 14 can be a tool such as a saw, a drill or a laser level; a toy; an electronic device such as a television, radio/stereo component, or speaker; or a sporting good such as a golf club bag. The connector 20 may be formed in or integrated with (wherein the casual observer cannot discern different components) the object 14. The connector 20 includes structure that is received by the base 40 to removably secure the object 14 to the base 40, which may be installed in the support surface 18. In the embodiment of FIG. 1, the connector 20 is a ring assembly 21 that includes an upper ring segment 22 and a lower ring segment 24. The upper and lower rings segments 22, 24 are joined with a fastener 26 to define a receiver 28 that securedly receives a portion of the object 14, which is shown as being tubular or cylindrical. Preferably, the fastener 26 extends through a flange portion 25 of the ring segments 22, 24. Although shown as having a circular periphery, the receiver 28 can have other configurations to engage the object 14. For example, the receiver 28 can have a U-shaped or V-shaped configuration to cradle an extent of the object 14. Alternate configurations of the connector likewise can be used. A liner 29 can be positioned within the receiver 28 to minimize the chance that the ring segment 22, 24 scratches the exterior surface of the object 14.

As shown in the Figures, the lower ring segment 24 includes a body portion 30 with a depending elongated plug 32. The plug 32 has a sloped outer wall arrangement 32*a* which results in the plug 32 being tapered. Preferably, the plug 32 is downwardly tapered such that the diameter of the plug 32 at an upper plug portion 32*b* is greater than the diameter at a lower plug portion 32*c*. A generally horizontal wall 31 is positioned at an upper portion of the plug 32 wherein the wall 31 engages an upper surface 40*a* of the base 40 in the secured position SP. The plug 32 further includes a slot 34 that extends inward from the side wall 32*a*. The slot 34 includes a horizontal upper wall 34*a*, a vertical internal wall 34*b*, and lower wall 34*c* which can be angled. An angled shoulder 36 is positioned between the slot 34 and an end wall 38 of the plug 32. The slot 34 has an internal depth measured from the outer wall 32*a* that is approximately half of its diameter. As explained in greater detail below, when the mounting apparatus 10 is in the secured position SP, the plug 32 extends into the base 40 and is securedly engaged by an extent of the keeper 60.

Figure 2:
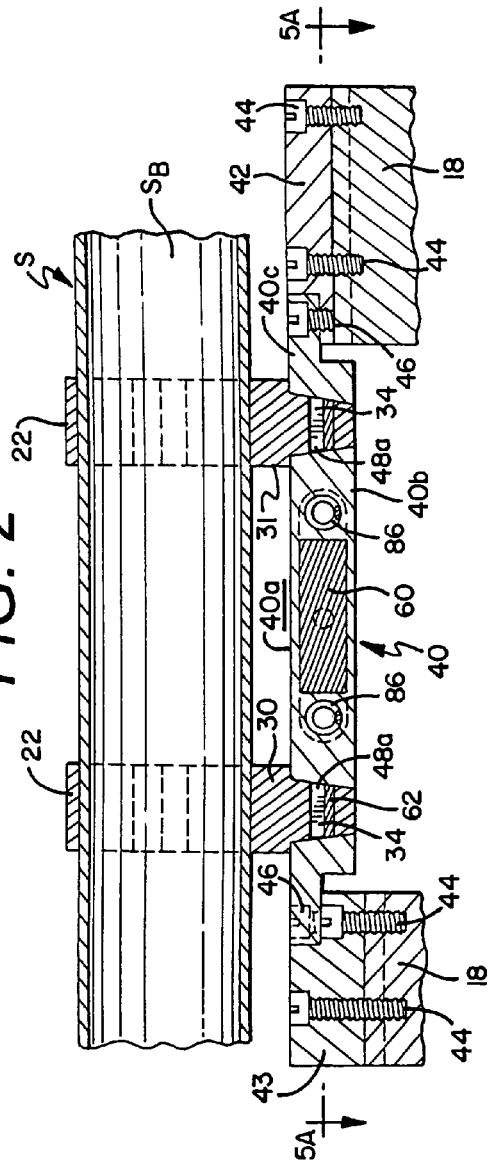
FIG. 2 is a cross-sectional view of the coupler taken along line 2-2 of FIG. 1, showing an elongated body S secured by the coupler.
Figure 2A:
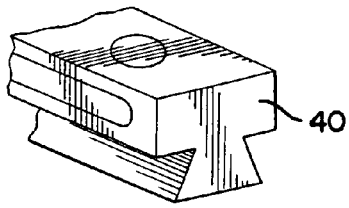
FIGS. 2A-E are perspective views of a base and a support structure configurations of the coupler apparatus.
Figure 2B:
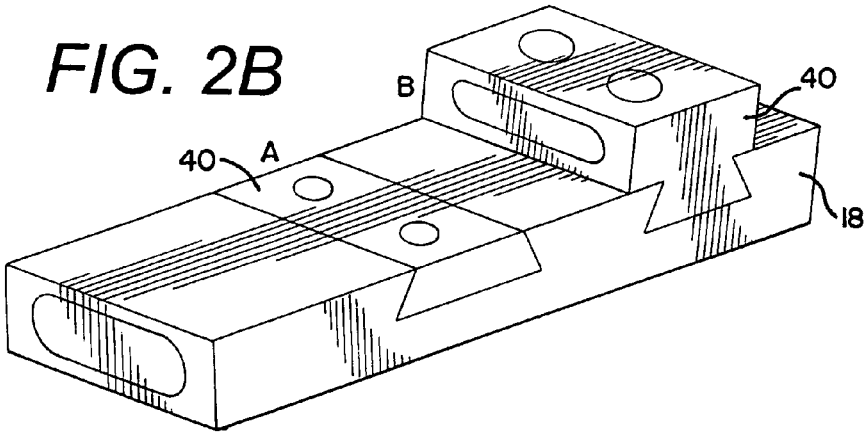
Figure 2C:
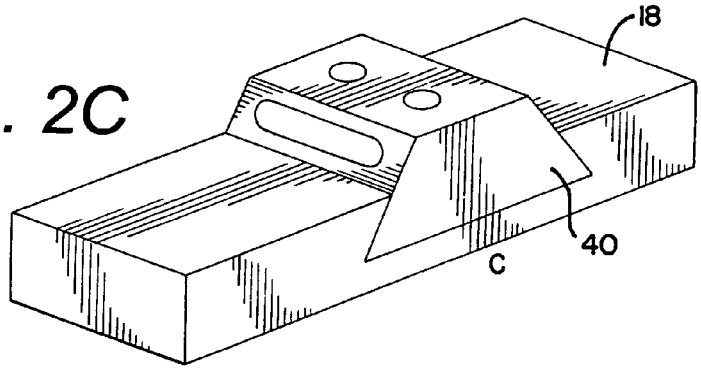
Figure 2D:
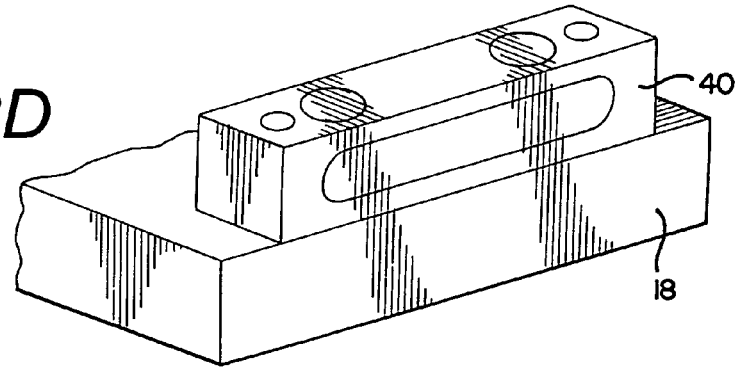

Although the ring assembly 21 is shown as having two distinct segments 22, 24, the ring 21 can have a single lower segment 24 that is affixed to the object 14 without encircling it as shown in FIGS. 1 and 2. For example, the segment 24 can be integrally formed with the object 14. In another embodiment of FIG. 1A, an upper portion of the plug 32 has threads 32*c* on a plug projection 32*d* that allow the plug to be screwed directly into a cavity or receiver of the object 14. Alternatively, the plug may be welded to an object. In another embodiment of FIG. 1B, the threads 32*c* are omitted and the plug projection 32*d* has at least one detent 32*e*, such as a small spring-loaded ball bearing, that secures the projection 32*d* within the receiver to join the plug 32 to the object 14. The plug 32 can have at least one elastomeric gasket or ring that acts to dampen the shock or vibration transmitted between the base 40, the support structure 18 and the object 14.

Figure 2E:
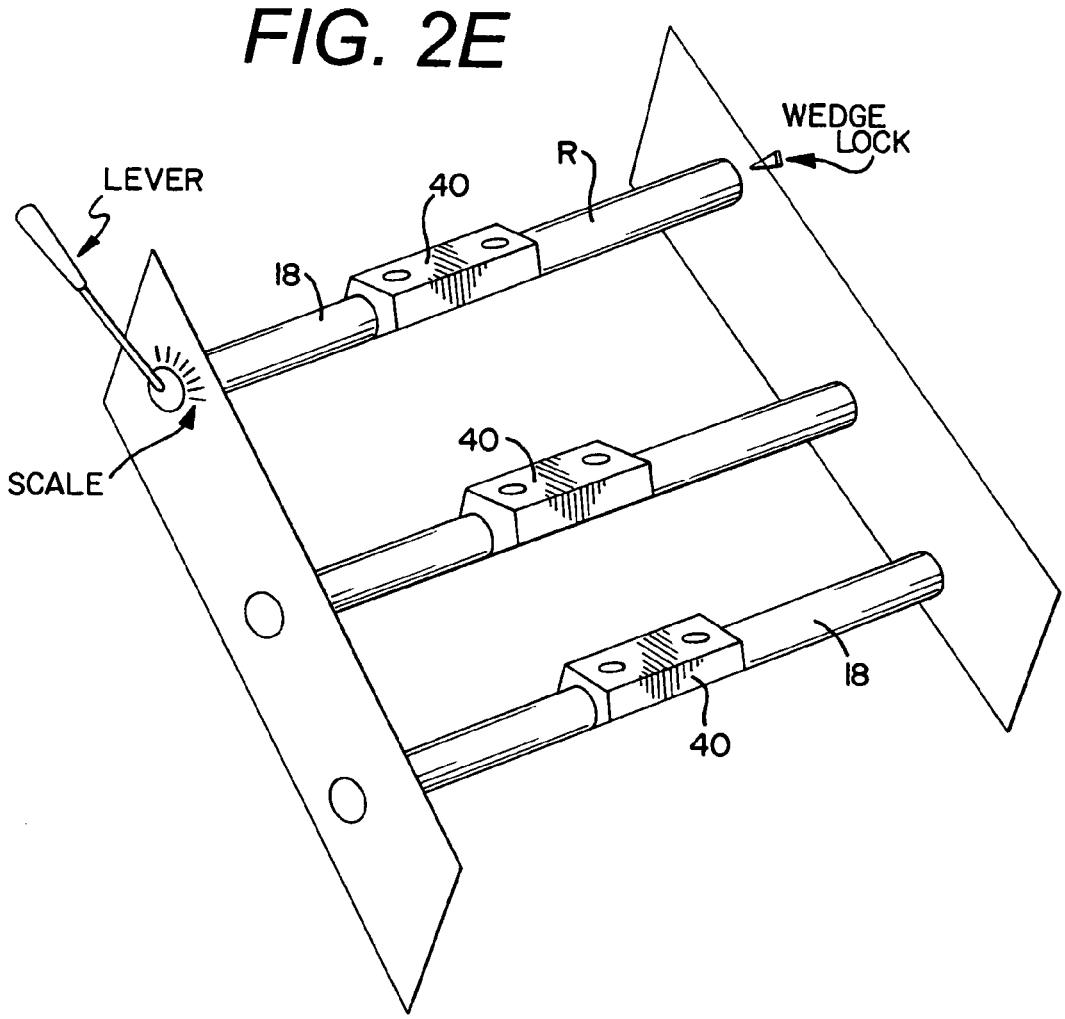

As shown in FIGS. 1 and 2, the base 40 is an elongated support structure that is affixed to a portion of the support structure 18 by a front mounting tab 42 and a rear mounting tab 43. Alternate mounting configurations of the base 40 in the support structure 18 are shown in FIGS. 2A-D. FIG. 2E shows an alternate mounting arrangement where the base 40 is installed on a cylindrical shaft or rod R that can be rotated by lever L. As explained above, the base 40 may be formed in or integrated with (wherein the casual observer cannot discern different components) the support structure 18.

Figure 1C:
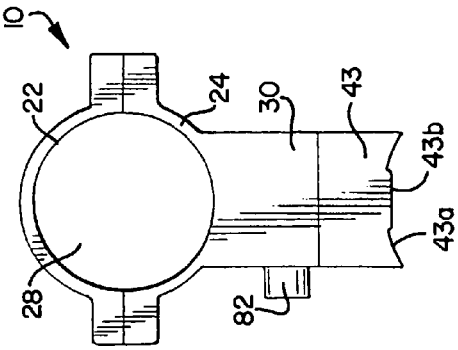
FIG. 1C is an end view of an alternate coupler of FIG. 1, the coupler having a curvilinear base.

The base 40 includes the upper surface 40*a* and a main body portion 40*b*. Referring to FIG. 4, at least one fastener 44 that extends through an aperture 44, wherein the fastener 44 secures the mounting tabs 42, 43 to the frame $F_F$ such that the base 40 is positioned above the support structure 18 and peripheral base ledges 40*c* engage the respective mounting tabs 42, 43. Due to the configuration of the mounting apparatus 10, including the base 40 and the tabs 42, 43, the operation of the support structure 18 is not compromised. Referring to FIG. 1, the base 40 includes at least one aperture 45 that receives a fastener 46 to secure the base 40 to each mounting tab 42, 43. The tab 42, 43 has a bottom wall 43*a* that is dimensioned to engage an upper surface of the tool. The bottom wall 43*a* can have a curvilinear configuration which defines a convex or concave support structure 18 engaging surface. Alternatively, the bottom wall 43*a* can have an angled or linear configuration. In another alternative shown in FIG. 1C, the tab 43 has a concave bottom wall 43*a* with a centrally positioned rail 43*b*.

Figure 4A:
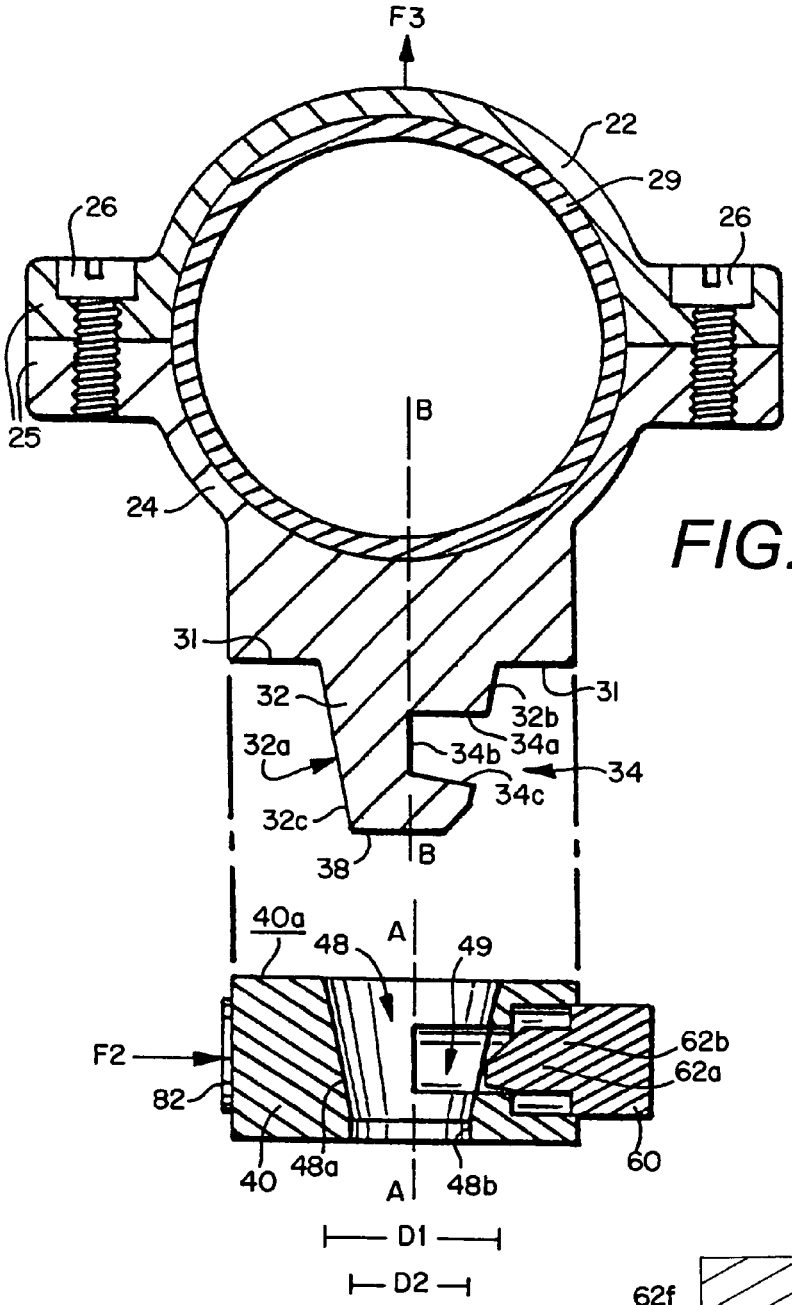
FIG. 4A is a cross-sectional view of the coupler apparatus taken along line 4-4 of FIG. 1, showing the apparatus in the detached position wherein the connector is separated from the base.

The base 40 includes an aperture 48 that is cooperatively dimensioned with the plug 32 of the connector 20 for its reception. In one embodiment, the aperture 48 has a tapered configuration with a sloped internal wall arrangement 48*a* wherein the diameter D1 at an upper portion of the aperture 48 is greater than the diameter D2 at a lower portion of the aperture 48. During insertion of the plug 32, the plug's sloped wall 32*a* slidingly engages the aperture's sloped wall 48*a*. The inner surface of the sloped wall 32*a* can be polished or coated with a substance to reduce the coefficient of friction between the wall 32*a* and the plug 32 and to facilitate reception of the plug 32. Referring to FIG. 4A, a lower portion of the aperture 48 can include a vertical segment 48*b*. The aperture 48 is shown extending through the base 40; however, the height of the base 40 and/or the aperture 48 can be lessened such that the aperture 48 extends through a substantial extent of the base 40. As shown in FIG. 6, the aperture 48 includes an orifice 49 in the internal wall 48*a* that receives a finger 62 of the keeper 60. Therefore, the orifice 49 is a passageway between the aperture 48 and the internal cavity 50. As explained below, the finger 62 extends through the orifice 49 and is received in the slot 34 of the plug 32. The orifice 49 shown in FIG. 8 has a curvilinear or crescent-shaped configuration when viewed from above. Regardless of its configuration, the orifice 49 is dimensioned to allow at least a leading portion 62*a* of the finger 62 to extend through the orifice 49. Thus, the orifice 49 acts as a passageway for the finger 62 from the cavity 50 into the aperture 48. Although the base 40 is shown in the Figures as having two apertures 48, it can have a single aperture 48 or many apertures 48. In the latter scenario, the apertures 48 can be arranged to form a triangle, whereby legs connecting pairs of the apertures 48 define the triangle. It is understood that numerous apertures 48 could define a square, pentagon or a jagged-saw tooth pattern. A base 40 having many apertures 48 provides a number of options for selectively securing the object 14 since the relative positioning of the connector to the object 14 can be selectively adjusted for the dimensions of the object 14. An elastomeric plug (not shown) can be inserted into the unused aperture(s) 48 to prevent the accumulation of moisture and/or foreign matter. Referring to FIG. 4A, the aperture 48 has a longitudinal axis A-A and the plug 32 has a longitudinal axis B-B.

The base 40 further includes an internal cavity 50 that receives an extent of both the keeper 60 and the release assembly 80, depending upon the position of the apparatus 10. As shown in FIG. 6, internal cavity 50 includes a main cavity segment 50*a* that slidingly receives a central portion 64 of the keeper 60 and the actuator 82. As a result, the main cavity segment 50*a* includes an opening in both sides of the base 40. Described in a different manner, the main cavity segment 50*a* extends between a first outer base wall 40*d* and a second outer base wall 40*e* (see FIG. 6). The cavity 50 includes an internal wall arrangement 52 that defines boundaries of the cavity 50. The wall arrangement 52 includes a staggered or notched cavity wall 52*a*, a first inner cavity wall 52*b* and a second inner cavity wall 52*c*. The wall arrangement 52, and its components, may engage portions of the keeper 60 and the actuator 80 depending upon their position, and thereby acts as a restriction. The cavity 50 further includes two peripheral segments 50*b* that each receive an arm 66 and finger 62 of the keeper 60. Preferably, each segment 50*b* includes a finger recess 50*c* that extends inward into communication with the aperture 48 via the orifice 49, wherein the finger recess 50*c* receives an extent of the finger 62. As shown in FIG. 6, both the finger recess 50*c* and the finger 62 have a rectangular configuration when viewed from above.

As mentioned above, the keeper 60 is slidingly received within the base 40 by the cavity 50. In the embodiment of FIG. 6, the keeper 60 has a generally T-shaped configuration when viewed from above and is configured to interact with the plug 32 to retain the connector 20 in the secured position SP. Along those lines, an arm 66 extends outward from the central portion 64 of the keeper 60. Near its outer end 66*a*, the arm 66 has an outwardly extending finger 62. The finger 62 includes the frontal or leading portion 62*a* extending forward from a main body portion 62*b*. While the arm 66 is received within the peripheral segment 50*b*, the finger 62 is received within the finger recess 50*c*. There is a notched or staggered wall 52*a* between the peripheral segment 50*b* and the finger recess 50*c* that, along with the inner cavity wall 52*b*, engages and constrains inward movement of the keeper 60. In a similar manner, the second inner cavity wall 52*c* engages and constrains movement of the actuator 82. Accordingly, the internal cavity 50, including the internal wall arrangement 52, is configured to slidingly receive the keeper 60. The keeper 60 has a height or thickness measured between upper and lower surfaces that ranges from 0.0625 to 0.5 inch, and a preferred height range from 0.125 to 0.25 inch.

Figure 3B:
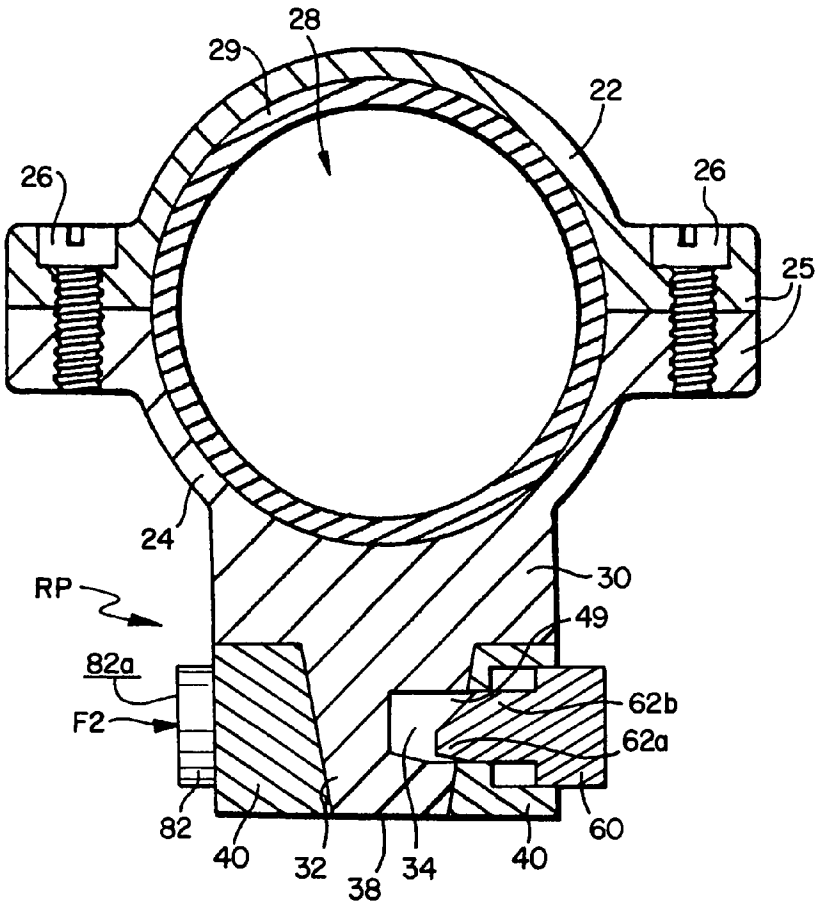
FIG. 3B is a cross-sectional view of the coupler apparatus taken along line 3-3 of FIG. 1, showing the apparatus in a released position.
Figure 3A:
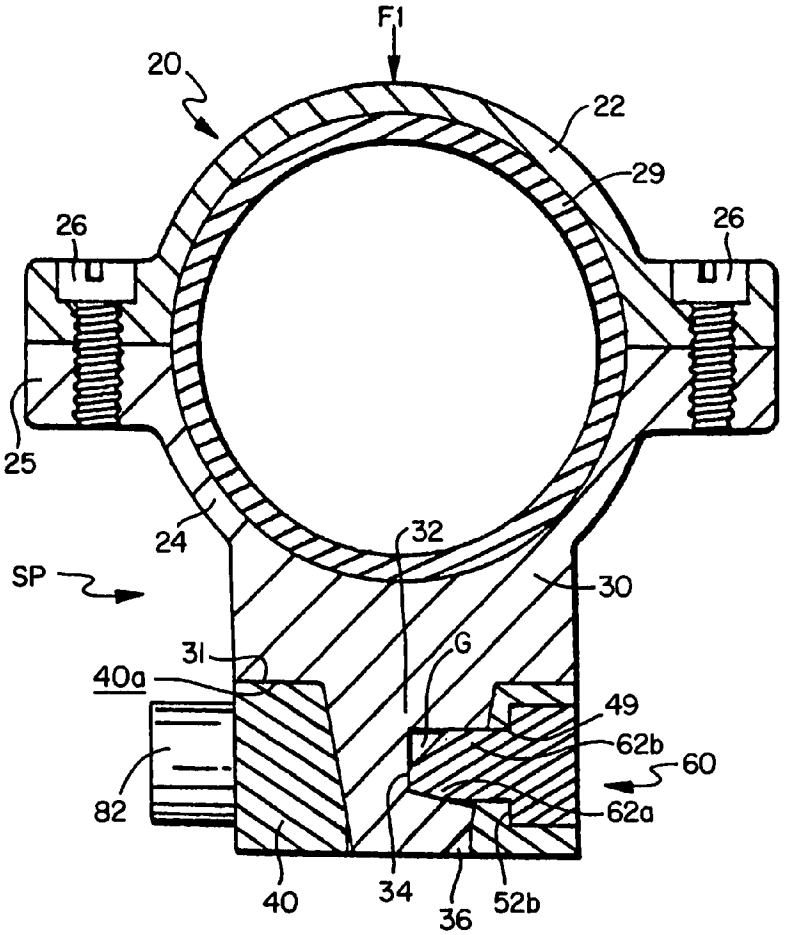
FIG. 3A is a cross-sectional view of the coupler apparatus taken along line 3-3 of FIG. 1, showing the apparatus in the secured position.
Figure 4B:
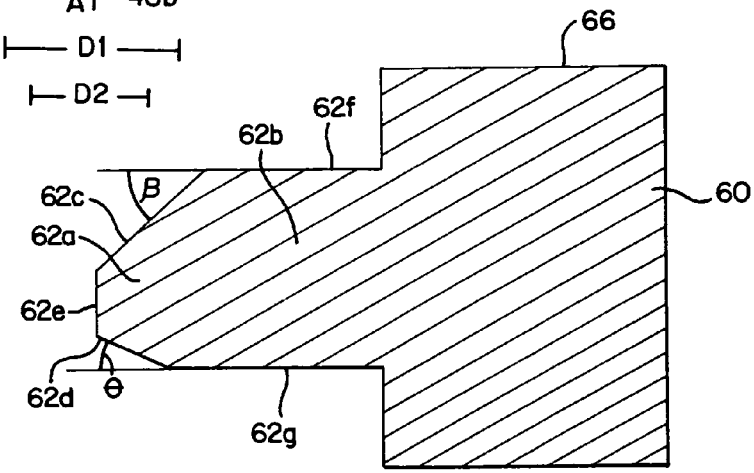
FIG. 4B is a schematic view of the keeper finger of the coupler apparatus.
Figure 8:
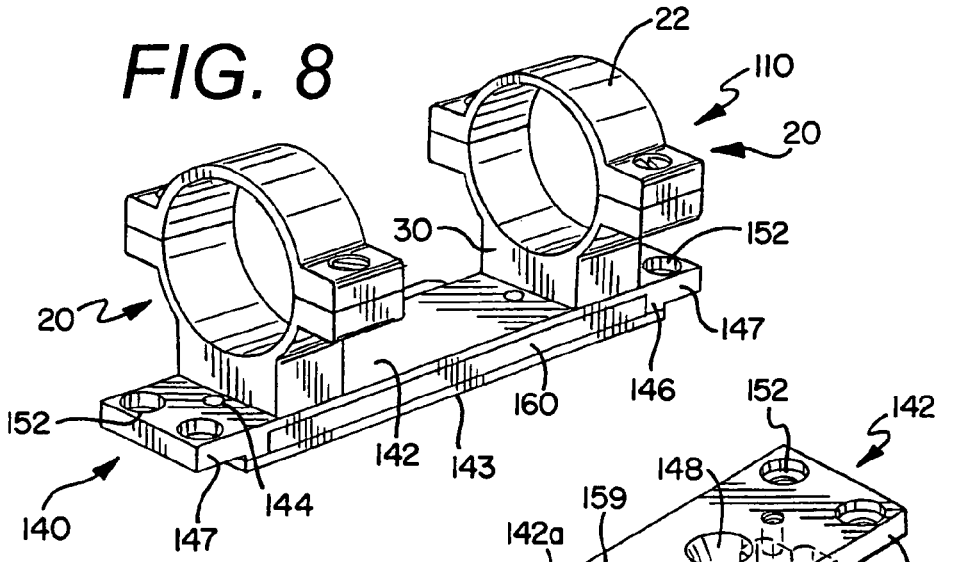
FIG. 8 is a perspective view of an alternate coupler apparatus of the invention.

As shown in FIG. 4B, the leading portion 62*a* includes an upper inclined surface 62*c*, a lower inclined surface 62*d* and a vertical surface 62*e* that extends between the two surfaces 62*c, d*. The upper inclined surface 62*c* is sloped at an angle β to the horizontal that ranges between 30 and 50 degrees, with a preferred angle of approximately 45 degrees. The lower inclined surface 62*d* is sloped at an angle Θ to the horizontal that ranges between 5 and 20 degrees, with a preferred angle of approximately 10 degrees. The main body portion 62*b* has an upper surface 62*f* and a lower surface 62*g*. In the released position RP of FIG. 3B, the finger 62 is disengaged from the slot 34 whereby the finger 62 is disassociated with the plug 32. In the secured position SP of FIG. 3A, an extent of the finger 62 is received by the slot 34 to securedly retain the plug 32 within the block 40. In the secured position SP, a clearance or gap G is formed between the plug 32 and the finger 62 in the slot 34. Preferably, the gap G resides proximate an upper portion of the finger 62. The central portion 64 of the keeper 60 has a generally rectangular configuration with an opening 68 that receives a fastener 84 that joins the actuator 82 to the keeper 60. In a preferred embodiment, the number of fingers 62 equals the number of apertures 48 and plugs 32. Therefore, a single keeper 60 engages and locks multiple plugs 32 in the secured position SP to rigidly secure the object 14 to base 40 and the support structure 18. An alternate keeper 60 is shown in FIG. 4C. There, the keeper finger 62 has an undercut 63 that forms a notch 63*a* in a lower portion of the finger 62 to further retain the plug 32 in the secured position SP. FIG. 8 shows various alternate configurations of the finger 62, including the leading portion 62*a*.

Figure 5B:
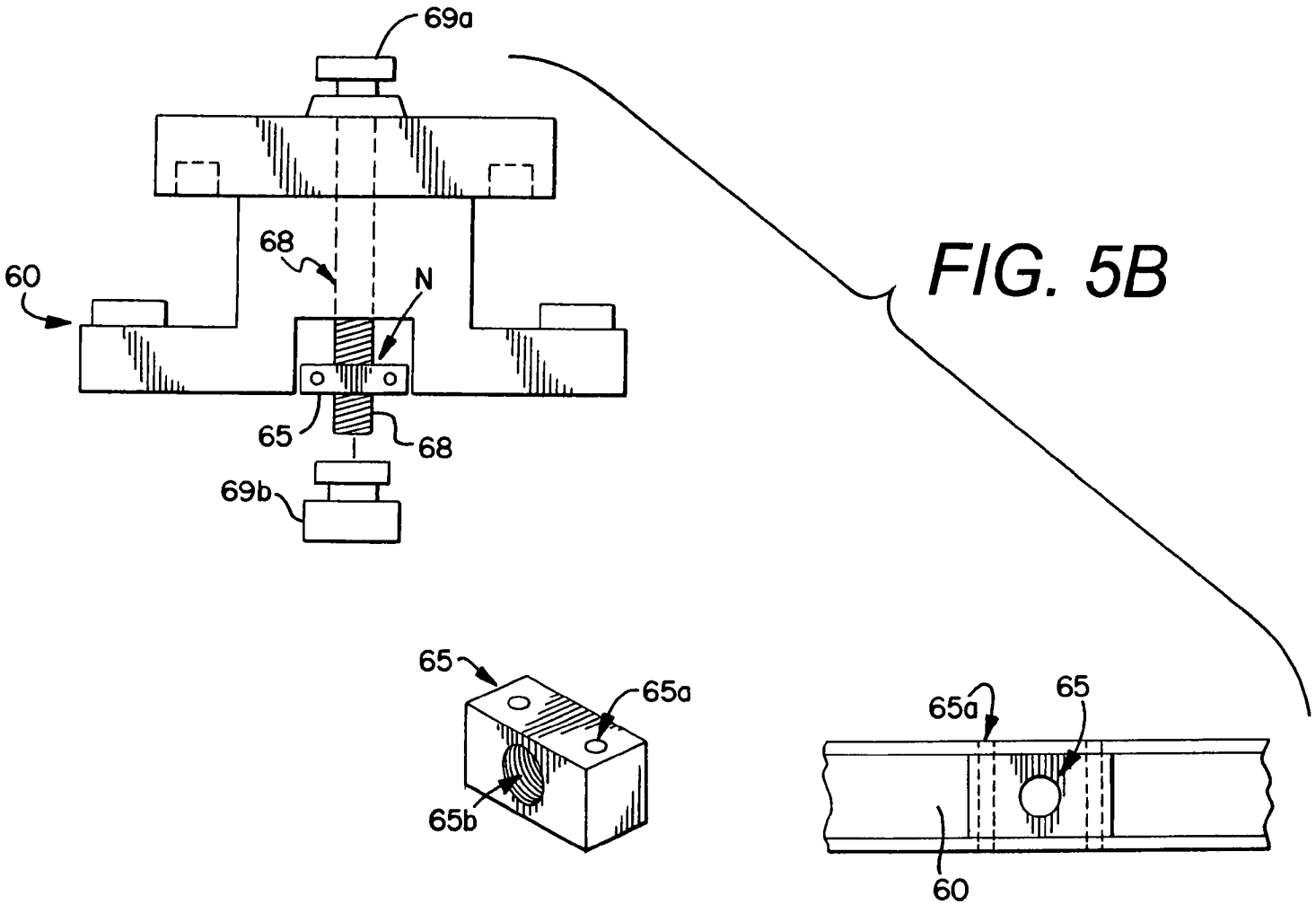
FIG. 5B is a top plan view of the coupler apparatus showing an alternate arrangement to connect the release assembly to the keeper.

The release assembly 80 includes an elongated actuator member 82, at least one means for biasing the actuator 82, and the fastener 84. The release assembly 80 is designed to be actuated by an operator to allow the object 14 to be moved between the secured position SP and the detached position DP. The biasing means can be a spring, such as a helical spring 86 (see FIGS. 5A and 6) or a flat spring. The spring 86 is positioned between the actuator member 82 and the base 40. A first end of the spring 86 is received within a receptacle 50*f* of the block cavity 50, and a second end of the spring 86 is received within a well 88 of the actuator 82. The spring 86 has an axis of operation that is substantially perpendicular to a major axis of the base 40 and a longitudinal axis of the aperture 48. Described in a different manner, the spring 86 exerts a biasing force upon the actuator 82 and the keeper 60 connected thereto in a direction that is substantially perpendicular to a major axis of the base 40 and a longitudinal axis of the aperture 48. The fastener 84 extends through a passageway 90 in the actuator 82 and is received by the opening 68 in the keeper 60 to couple the actuator 82 to the keeper 60. Once coupled, the actuator 82 and the keeper 60 are moveable in the indicated direction D, which represents movement into and out of the cavity 50 of the base 40. The movement D results from the application of an inwardly directed force on the actuator 82, or a downwardly directed force on the plug 32 into the block aperture 48. Described in a different manner, the movement D occurs substantially perpendicular to a vertical axis of the aperture 48 and/or a longitudinal axis of the plug 32. FIG. 5B shows an alternate arrangement to connect the release assembly 80, including the actuator 82, to the keeper 60. There, the combination of the fastener 64, a first thumb screw 69*a*, an optional second thumb screw 69*b*, and a fastener block 65 is utilized to connect the actuator 82 and the keeper 60. The fastener block 65 resides within a notch N in the keeper 60 that allows for clearance and travel of the fastener block 65. The fastener block 65 includes at least one pin hole 65*a* and a central opening 64*b* that receives an extent of the fastener 64. Alternatively, if the diameter of the thumb screw 69*b* is greater than the width of the notch N in the keeper 60, the thumb screw acts as a lock for the keeper As mentioned above, the mounting apparatus 10 allows the object 14 to be moved between an initial position, the secured position SP (see FIGS. 1, 3A), the released position RP (see FIG. 3B) and the detached position DP (see FIG. 4A) wherein the object 14 can be removed from the support structure 18, and then secured to another support structure 18. Once the detached position DP is reached, a second object 14 connected to a connector 20 can be quickly affixed to the support structure 18 with the mounting apparatus 10. In this manner, the apparatus 10 allows the rapid interchangeability of various object 14*s*. Alternatively, the object 14 can be affixed to a second base 40 and second support structure 18 wherein the object 14 can be rapidly moved between various support structures 18. The operation of the apparatus 10, including its components, is described in the following paragraphs.

In an initial position of the apparatus 10, the base 40 is mounted to or integrated within the support structure 18, and the connector 20 is affixed to or integrated within the object 14 but not connected to the base 40. Accordingly, the plug 32 is not positioned within the aperture 48 of the base 40. The leading edge 62*a* of the finger 62 extends through the orifice 49 into the aperture 48. However, the leading edge 62*a* merely extends into the aperture 48 and does not engage the plug 32. The initial position occurs prior to an object 14 being connected to the support structure 18 and after an object 14 is removed from the support structure 18.

To reach the secured position SP, the operator brings the object 14 into close proximity to the base 40, wherein an insertion force F1 (see FIG. 3A), directed towards the base 40, is applied to the object 14 and/or connector 20 to insert the plug 32 into the aperture 48. Because the keeper 60 is connected to the actuator assembly 80, the insertion force should be large enough to compress the spring 86 which allows for movement of the actuator 82 into the cavity 50 of the base 40. The spring 86 is compressed in a direction that is substantially perpendicular to the major axis of the base 40 and the longitudinal axis A-A of the aperture 48. Provided a sufficient insertion force is applied, the bottom wall 38 of the plug 34 engages the leading edge 62*a* of the finger 62 and displaces the finger 62 from the aperture 48. Specifically, the bottom wall 38 and the shoulder 36 engage the upper inclined surface 62*c* and the vertical surface 62*e* and displaces the finger 62 away from the plug 34. Due to the displacement, the finger 62 moves outward or away from the actuator 82 such that the outer keeper wall 60*a* extends beyond the outer base wall 40*e*. The displacement of the keeper 60 continues until the finger 62 exits the aperture 48 through the orifice 49 thereby creating a clearance for the plug 32 to be received within the aperture 48. Assuming the insertion force is continuously applied, the plug slot 34 and the shoulder 36 clear the leading portion 62*a* which allows the keeper 60 to move inward towards the actuator 82 and away from the outer base wall 40*e*. The inward movement of the keeper 60 results from the biasing force provided by the compressed spring 86 and continues as the finger 62 extends through the orifice 49 and into the plug slot 34. The biasing force provided by the spring 86 to the keeper 60 is oriented substantially perpendicular to the longitudinal axis A-A of the aperture 48 and B-B of the plug 32 (see FIG. 4A for axes A-A, B-B). Therefore, the keeper 60 moves towards the right (see FIG. 5) and past the outer base wall 40*e* until the clearance sufficient for insertion of the plug 34 in the aperture 48 is achieved. Thereafter, the keeper 60 moves to the left (FIG. 5), causing the finger 62 to extend through the orifice 49 and into the plug slot 34. Accordingly, the keeper 60 and actuator 80 move in a first direction and then a second direction that is opposite the first as the plug 32 is inserted into the aperture 48 to reach the secured position SP. Once the leading edge 62*a* is received by the plug slot 34, the apparatus 10 is in the secured position SP.

In the secured position SP, the reception of the plug 32 within the aperture 48 couples the object 14 to the support structure 18. Referring to FIG. 3A, the finger 62 extends through the orifice 49 and is received by the slot 34 to retain the plug 32 within the aperture 48 and prevent upward movement of the object 14 relative to the base 40. Specifically, the leading edge 62*a* resides within the slot 34, and the body portion 62*b* resides within and external to the slot 34. As shown in FIG. 5, the leading edge 62 extends into the slot 34 a substantial amount such that the edge 62*a* approaches a midpoint of the aperture 48. Furthermore, the upper inclined surface 62*c* is spaced a distance from the horizontal upper wall 34*a* and the vertical internal wall 34*b* to define the gap G; the lower inclined surface 62*d* engages the angled lower wall 34*c*; the vertical surface 62*e* engages a lower portion of the vertical internal wall 34*b*; the upper surface 62*f* engages an extent of both the horizontal upper wall 34*a* and the orifice upper wall 49*a*; and, the lower surface 62*g* engages an extent of both the angled lower wall 34*c* and the orifice lower wall 49*b*. Over time and repeated use, portions of the apparatus 10, including the plug 32, the spring 86, the actuator 82, and the keeper 60, may wear; however, this wear does not adversely affect the operation of the apparatus 10 since such wear causes the finger 62, including the lead edge 62*a*, to extend further into the slot 34. For example the angled lower slot wall 34*c* and the lower inclined finger surface 62*d* may wear from the sliding engagement there between; however, such wear enables the spring 86 to bias the lead edge 62*a* of the keeper finger 62 further into the plug slot 34. As a result, the locking engagement between the keeper 60 and the plug 32 is heightened over time and with wear.

Also in the secured position SP, the notched inner wall 52*a* engages an exterior portion of the keeper arm 66, and the inner cavity wall 52*b* engages an interior portion of the keeper arm 66. A first extent of the actuator 82 resides external to the base 40, and a second extent of the keeper 60 resides within the cavity 50. In a preferred embodiment, first keeper side wall 60*a* is aligned with the second outer wall 40*e* of the base 40 and a second keeper side wall 60*b* is positioned slightly inward of the first base outer wall 40*d* (see FIG. 5). The spring 86 is in an unstressed or uncompressed state whereby it does not exert a biasing force on the actuator assembly 80.

To move the coupler apparatus 10 from the secured position SP to the released position RP which leads to the detached position DP, an inwardly directed releasing force F2 (see FIGS. 3B, 5) is applied to the outer wall 82*a* of the actuator 82 in order to disengage the finger 62 from the plug slot 34. Described in a different manner, the releasing force F2 is oriented substantially perpendicular to the longitudinal axis A-A of the aperture 48 and B-B of the plug 32 (see FIG. 4A for axes A-A, B-B). The releasing force F2 compresses the spring 86 and displaces the keeper 60 and the finger 62 away from the aperture 48 such that the outer keeper wall 60*a* extends beyond the outer base wall 40*e*. The displacement of the keeper 60 towards the right (see FIG. 5) continues until the finger 62 exits the aperture 48 through the orifice 49 thereby releasing the leading portion 62*a* from the plug slot 34. Consequently, the finger 62 reaches the released or intermediate position RP wherein the finger 62 is separated or disassociated from the plug 32 and does not prevent removal of the plug 34 from the aperture 48 and the base 40. In the released position RP, the leading portion 62*a* is positioned external to the orifice 49 and the sidewall arrangement 48*a* of the aperture 48 whereby the finger 62 does not engage the plug 32 and the operator can then remove the object 14 from the base 40. In an alternate version, the leading portion 62*a* is retained within the orifice 49 but does not interact with slot 34 or obstruct the removal of the plug 32.

To remove the object 14 and arrive at the detached position DP from the released position RP, an upward detaching force F3 is applied to the object 14 and/or the connector 20. Referring to FIG. 4A, the detaching force F3 is a vertical force applied to the connector 20 whereby the plugs 34 are detached from the aperture 48 and the base 40. Preferably, the detaching force F3 is applied substantially perpendicular to the base 40 and the support structure 18. Described in a different manner, the detaching force F3 is applied substantially parallel to the longitudinal axis A-A of the aperture 48 and B-B of the plug 32. Unlike conventional object 14 mounting devices which require pivoting or rotation of the object 14 for removal that leads to contact between the object 14 and the support structure 18, the inventive apparatus 10 provides for linear detachment that prevents the object 14 from contacting the support structure 18. The contact necessitated by conventional mounting devices is problematic because such contact can damage the object 14 and/or limit the configuration or size of the object 14 to be mounted to the support structure 18.

Because the present apparatus 10 provides for linear detachment and no rotation or pivotal movement, the dimensions of the object 14 are not limited.

As the detaching force F3 is applied and the plug 32 vacates the aperture 48, the keeper 60 moves inward towards the aperture 48 and away from the outer base wall 40*e*. The inward movement of the keeper 60 results from the biasing force provided by the compressed spring 86 and continues as the finger 62 extends through the orifice 49 and into the plug slot 34. The biasing force provided by the spring 86 to the keeper 60 is oriented substantially perpendicular to the longitudinal axis A-A of the aperture 48 and B-B of the plug 32. Therefore, the keeper 60 moves left (see FIG. 5) until the inner wall arrangement 52*a, b* constrains further movement of the keeper 60 and the outer keeper wall 60*a* is aligned with the outer base wall 40*e*. Accordingly, the keeper 60 and actuator 80 move in a third direction and then a fourth direction that is opposite the third direction as the plug 32 is removed from the aperture 48 to reach the detached position DP. Since the object 14 and attached connector 20 have been detached, the leading finger portion 62*a* resides within the aperture 48 but does not engage a plug 32. After the apparatus 10 has returned to the initial position, a second object 14 connected to a connector 20 can be quickly affixed to the support structure 18. In this manner, the apparatus 10 allows the rapid interchangeability of various object 14*s* to the support structure 18.

Figure 9:
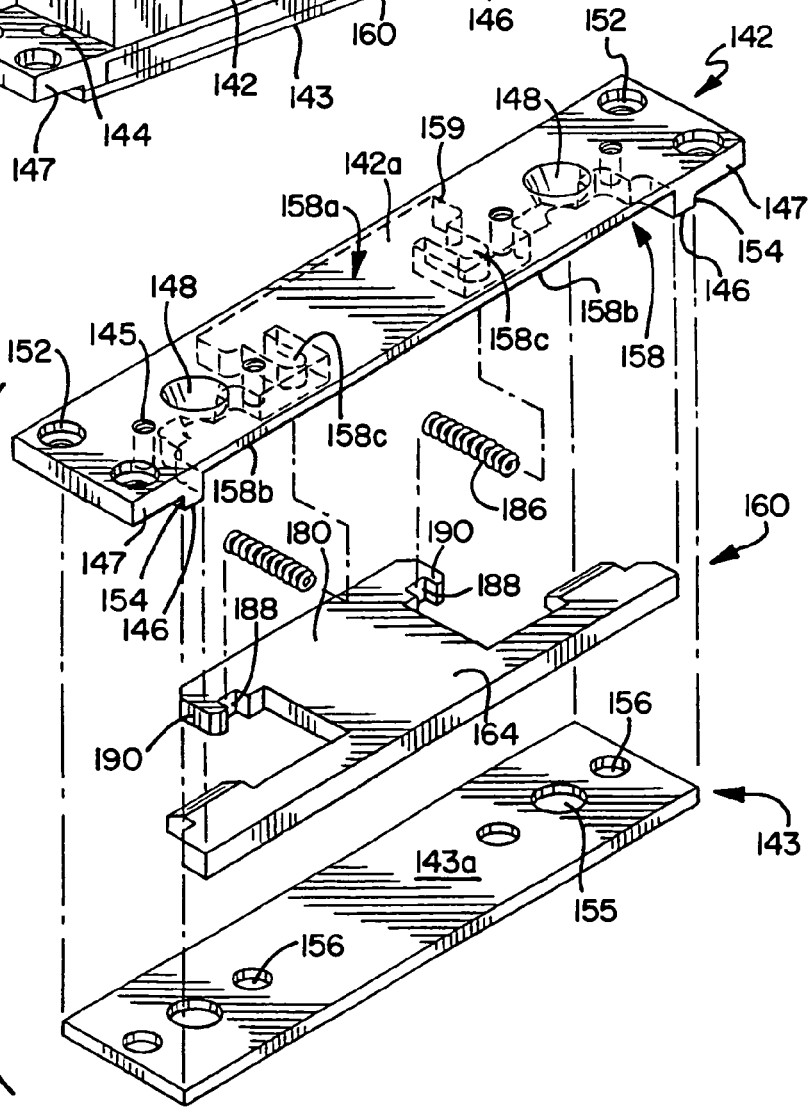
FIG. 9 is an exploded view of the coupler apparatus of FIG. 8, showing a integral, combined keeper and release actuator.
Figure 10:
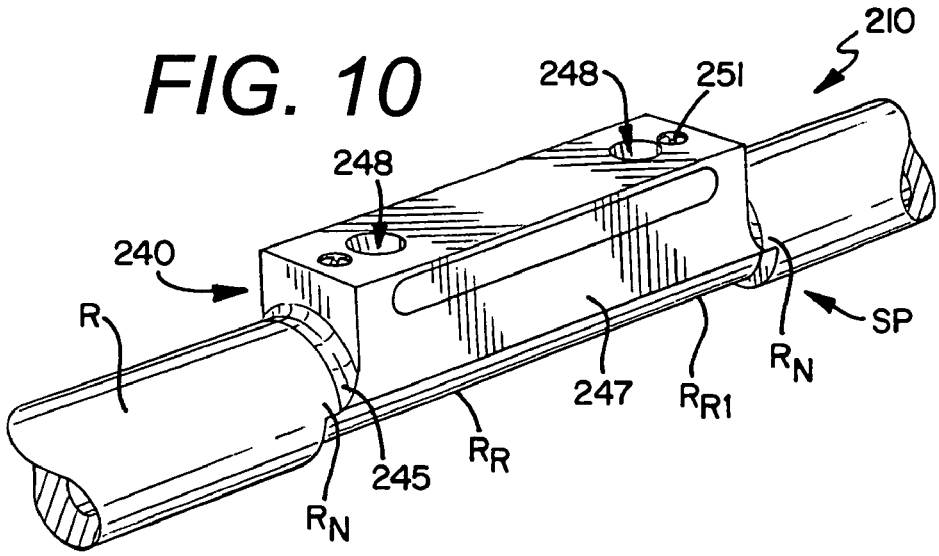
FIG. 10 is a perspective view of an alternate coupler apparatus, showing the mounting apparatus affixed to a rod.

An alternate coupler 110 is shown in FIGS. 8 and 9. The coupler apparatus 110 includes at least one connector 20, a base assembly 140 and a keeper 160 with an integrated release actuator 180, where both the connector 20 and the base 140 are similar to that explained above. Thus, the keeper 60 and the release assembly 80 of the previous embodiment are combined into a single keeper 160 that both secures the connector 20 and functions as an actuator. Although some structures of the coupler apparatus 110 are different from that of apparatus 10, the operation of the coupler apparatus 110 is consistent with that explained above. The object 14 and the connector 20 are moved between the initial position, the secured position SP and the detached position DP. Therefore, the apparatus 110 allows for the rapid and precise interchangeability of various object 14*s* to the support structure 18 without compromising the positional accuracy of the object 14 and the connector 20 with respect to the support structure 18. In contrast to conventional devices, the movement from the released position RP to the detached position DP occurs with a purely linear movement that does not require pivoting of the object 14, or the actuation of levers to detach the object 14 from the support structure 18. As explained above, the connector 20 may be integrated in the object 14 and the base 140 may be integrated in the support structure 18.

The base assembly 140 includes an upper elongated member 142 and a lower elongated member 143 that are connected by at least one fastener 144. The upper member 142 has opposed depending lugs 146 that engage an upper surface of the lower member 143 when the members 142, 143 are connected. The upper member 142 includes an opening 145 that receives an extent of the fastener 144. The upper member 142 further includes at least one aperture 148 that receives the plug 32 of the connector 20 as explained above for the coupler apparatus 10. Preferably, the aperture 148 is positioned inward of the depending lug 146. In the embodiment of FIGS. 8 and 9, the base 140 includes a pair of lugs 146 and a pair of apertures 148 wherein the apertures 148 are positioned inward of the lugs 146. The upper member 142 has a land or tab 147 external to the lug 146. At least one opening 152 extends through the tab 147 and is configured to receive a fastener (not shown) to secure the apparatus 110 to the support structure 18. A notch or step 154 is formed between the lug 146 and the tab 147. The thickness of the upper member 142 varies along its length. For example, the thickness at the lug 146 is greater than the thickness at the tab 147, and the thickness at both of these locations is greater than the thickness at a central member portion 142*a*. Thus, the lug 146 defines the lowermost portion of the upper member 142.

The lower member 143 includes at least one aperture 155 that is cooperatively dimensioned and positioned with the aperture 148 to receive an extent of the plug 32. The lower member 143 further includes a plurality of openings 156 wherein each opening 156 is cooperatively positioned with an opening 145 that receives the fastener 144. Although shown as having a planar configuration, the lower member 143 can have a curvilinear configuration which defines a convex or concave shape. When the base assembly 140 is connected, a lower surface of the lug 146 engages an upper surface 143*a* of the lower member 143. The lower member 143 has length less than the length of the upper member 142. Preferably, the length of the lower member 143 corresponds to the length or distance between the lugs 146. As such, the lower member 143 does not extend beyond the lug(s) 146 when the upper and lower members 142, 143 are connected. Due to the lugs 146, the upper and lower members 142, 143 define an internal cavity 158 that receives the keeper 160. As shown in FIG. 9, the internal cavity 158 includes a main cavity segment 158*a* that slidingly receives a central portion 164 of the keeper 160 and the actuator 180. As a result, the main cavity segment 158*a* includes an opening in both sides of the base 140. The cavity 158 includes an internal wall arrangement 159 that defines boundaries of the cavity 158. The cavity 158 further includes two peripheral segments 158*b* that each receive an arm 166 and finger 162 of the keeper 160. Preferably, each segment 158*b* includes a recess 158*c* that extends inward into communication with the aperture 148 wherein the recess 158*c* receives an extent of the finger 162.

The keeper 160 is configured to interact with the plug 32 to retain the connector 20 in the secured position SP. The keeper arm 166 extends outward from the central portion 164 of the keeper 160. The outwardly extending finger 162 includes the frontal or leading edge portion 162*a* outward of a main body portion 162*b*. The geometry of the finger 162 corresponds to that of the finger 62 explained above. In the secured position SP, an extent of the finger 162 is received by the slot 34 to securedly retain the plug 32 within the block 140. The release actuator 180 is joined to the central keeper portion 164 opposite the keeper arm 166. The release actuator 180 is actuated by an operator to allow the apparatus 110 and the object 14 to be moved between the secured position SP and the detached position DP. At least one means for biasing the actuator 180, such as a helical spring 186, is positioned between the actuator 180 and the base 140. Specifically, a first end of the spring 186 is received within a receptacle 158*c* of the block cavity 158, and a second end of the spring 186 is received within a well 188 formed by a notch 190 in a peripheral segment of the actuator 180.

Figure 11:
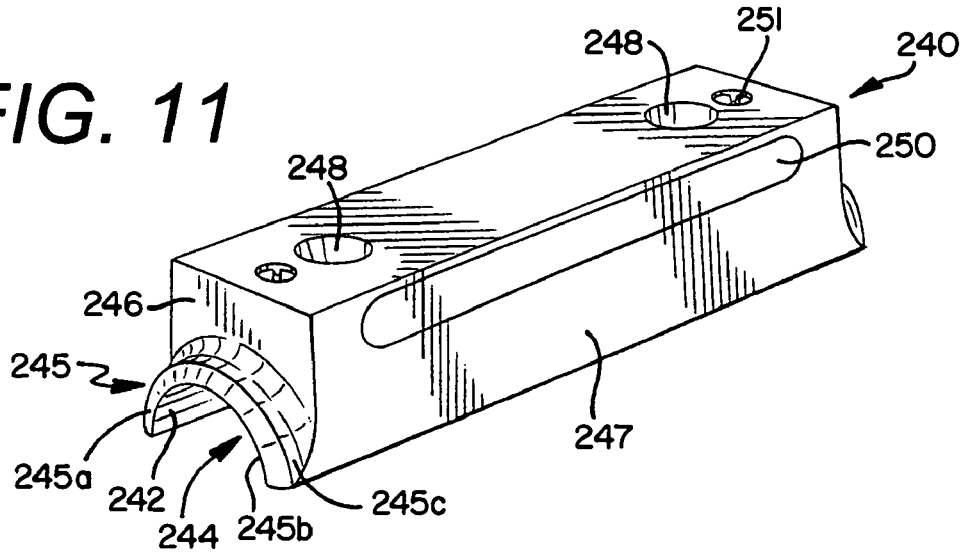
FIG. 11 is a perspective view of the coupler apparatus of FIG. 10.

Similar to FIG. 2E, FIGS. 10-12 show an alternate embodiment of the coupler apparatus 210 where the base 240 has a curvilinear bottom wall 242 that defines an curvilinear receiver 244 that securedly engages a recessed portion $R_R$ of the shaft or rod R, which can be rotatable. The rod R is an elongated structure that can be a component of a larger system or assembly. Referring to FIG. 11, each end of the receiver 244 has a lip 245 that extends outward from an end wall 246 of the base 240. The lip 245 has an angled front portion 245*a* that defines a leading edge 245*b* of the lip 245. Also, the lip 245 has a top wall 245*c* that leads to the end wall 246. A pair of side walls 247 extend between the end walls 246. Consistent with that explained above, the base 240 includes an aperture 248 and an internal cavity 250 that receives the keeper 60.

Figure 12:
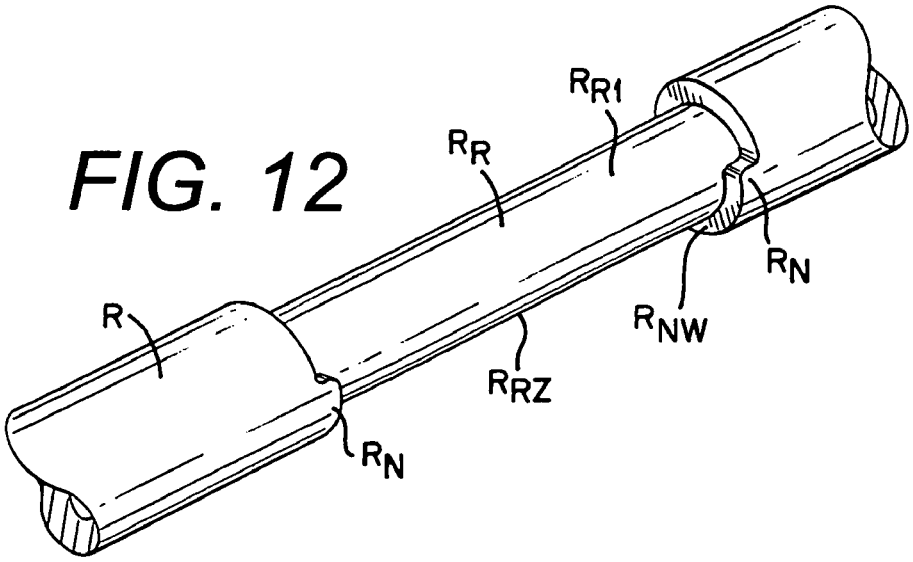
FIG. 12 is a perspective view of the rod to which the coupler apparatus is affixed.

As shown in FIG. 12, the recess $R_R$ is circumferential about the rod R and has a depth causing the diameter of the barrel recess $R_R$ to be less than that of the rod R. The recess $R_R$ includes opposed notched segments $R_N$ that are spaced a distance corresponding to the overall length of the base 240. To attach the base 240 to the rod R, the base 240 is brought into engagement with a first portion of the recess $R_{R1}$ then rotated, preferably approximately 180 degrees, to a second portion of the recess $R_{R2}$ between the notches $R_N$, whereby the lip 245 securedly engages the inner wall $R_{NW}$ of the rod R. Once the base 240 reaches the second portion $R_{R2}$, a secured position SP results (see FIG. 10). During the rotation from the first portion $R_{R1}$, the notches $R_{BN}$ facilitate the positioning of the lip 245 against the notch $R_{BN}$. In a preferred embodiment, the inner wall $R_{NW}$ is declined at an angle that corresponds to the angle of incline of the front portion 245*a* wherein the leading edge 245*b* is subsumed (see FIG. 10). To release the base 240 from the secured position SP, the base 240 is rotated, preferably approximately 180 degrees, from the second portion $R_{R2}$ to the first portion $R_{R1}$. In addition, the base 240 can include at least one set screw 251 to further secure the base 240 to the recessed rod portion $R_{BR}$.

Figure 13:
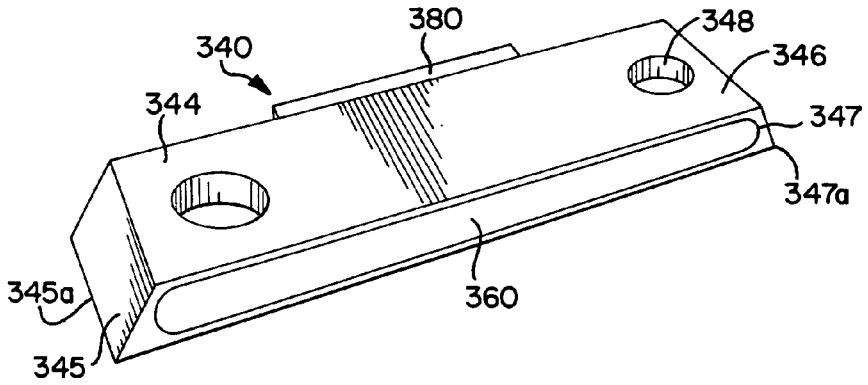
FIG. 13 is a perspective view of an alternate coupler apparatus, showing the base having opposed tenons.
Figure 14:
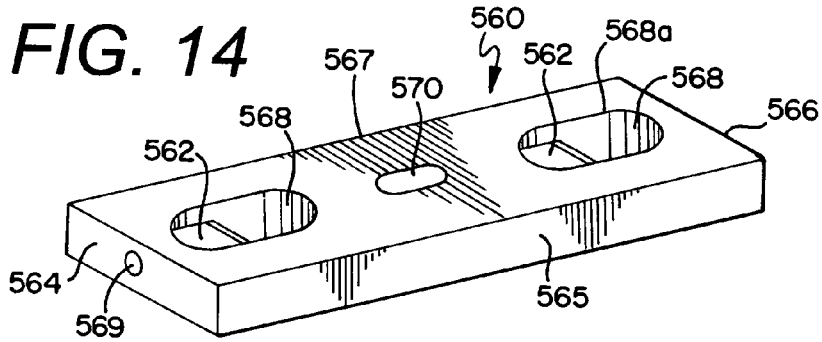
FIG. 14 is a perspective view of an alternate coupler apparatus.
Figure 15:
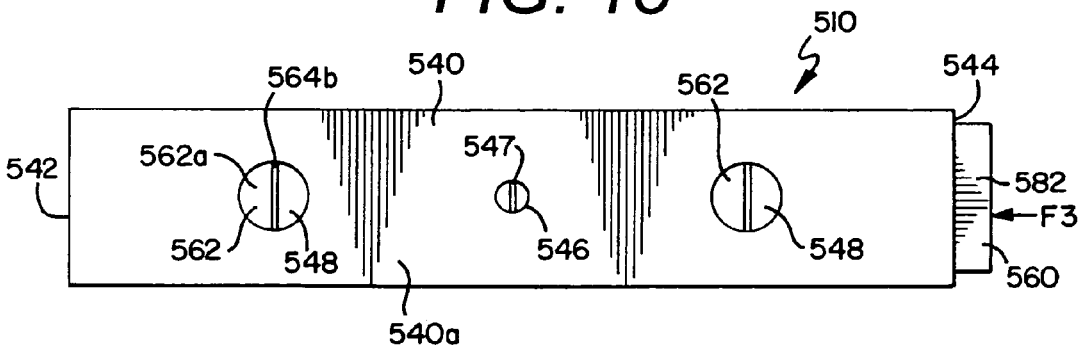
FIG. 15 is a top plan view of the coupler apparatus of FIG. 14.

Another embodiment of the inventive coupler apparatus 10 is shown in FIG. 13. There, the base 340 has a front end 344 with a front projection or tenon 345, and a rear end 346 with a rear projection or tenon 347, wherein the tenon 345, 347 defines a "dovetail." The tenons 345, 347 are angled or sloped to form a leading edge 345*a*, 347*a*. The base 340 is received within a slot formed in the support structure 18, such as the bay of the tool. The slot has a front mortise and a rear mortise that receive a respective tenon 345, 347. The structural interaction between the tenons 345, 347 and the mortises provides a friction fit to securedly retain the base 340 and the object 14 mounted thereto. Although the tenons 345, 347 are shown aligned on a major axis of the base 340, the base 340 can be reconfigured such that the tenons 345, 347 are aligned on a minor axis of the base 340. The mortise that receives the tenons 345, 347 aligned on a minor axis of the base 340 would then be formed in side portions of the slot in the support structure 18. The base 340 also includes at least one aperture 348, the internal cavity 350, the keeper 360, and the actuator 380.

Another embodiment of the inventive coupler apparatus 10 is shown in FIGS. 14-18. There, the coupler apparatus 510 includes a base 540 and a keeper 560 that securedly engages a connector 20 (not shown) as explained above. The base 540 has a generally rectangular configuration with a closed first end wall 542 and a second wall 544 with an opening 545 that is in communication with an internal cavity 540 that slidingly receives the keeper 560. The base 540 further includes an upper wall 540*a* and a lower wall 540*b*, wherein the upper wall 540*a* includes an opening 546 through which a fastener 547 extends. As explained below, the fastener 547 extends through the base 540 and the keeper 560. The base 540 further includes at least one aperture 548, which is preferably tapered in a manner consistent with the aperture 48 explained above. The aperture 548 is cooperatively dimensioned with the plug 32 of the connector 20 for reception of the plug 32. A spring 586 is positioned between a first end 560*a* of the keeper 560 and a solid portion 542*a* of the first end 542. The first solid portion 542 includes a well 543 that receives a first portion of the spring 586, and the keeper 560 includes a receptacle 569 that receives a second end of the spring 586. Consistent with that explained above for the apparatus 10, the spring 586 provides a biasing force upon the keeper 560 as the apparatus 510 is moved between the secured position SP, the released position RP and the detached position DP. The well 543 and the receptacle 569 may be omitted, wherein a retention cap is detachably connected to the first end 542 to securedly position the spring 586 against the keeper 560.

Figure 16:
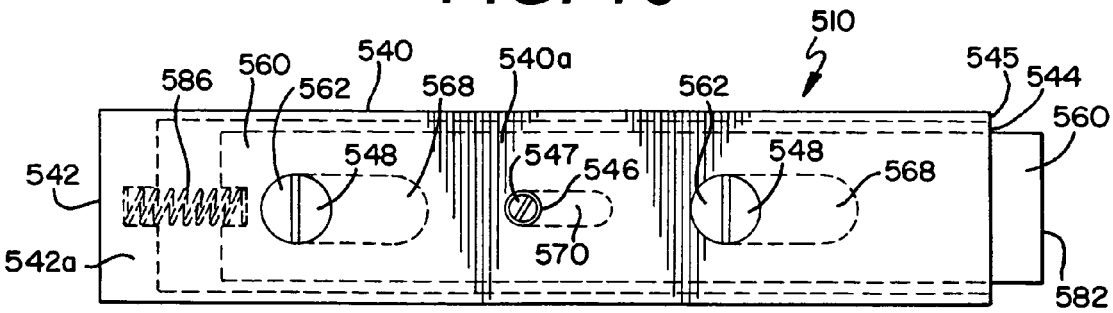
FIG. 16 is a to plan view of the coupler apparatus of FIG. 14, showing hidden structure in broken lines.
Figure 17:
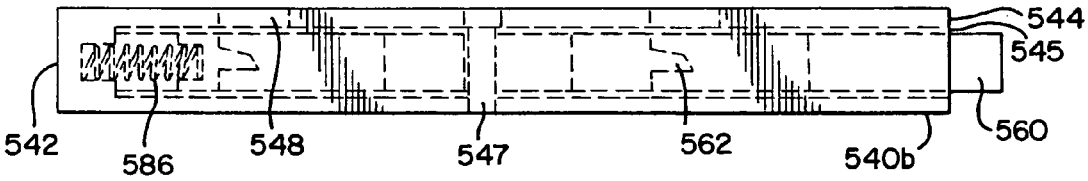
FIG. 17 is a side view of the coupler apparatus of FIG. 14, showing hidden structure in broken lines.
Figure 18:
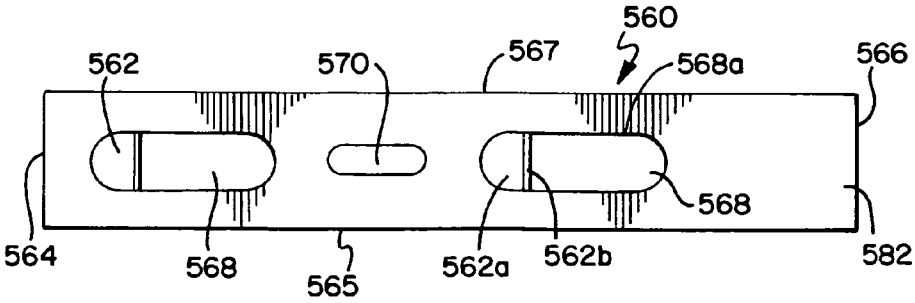
FIG. 18 is a top plan view of the coupler apparatus of FIG. 14.

In contrast to the keeper 60, the keeper 560 has a generally rectangular periphery with at least one internal finger 562, meaning a finger 562 residing within a periphery of the main keeper body. The keeper 560 has a first end 564, a second end 566 that extends through the open second wall 544 to define an actuator 582. The keeper 560 also has front wall 565 and a rear wall 567 wherein the front and rear walls 546, 548 are curvilinear (see FIG. 17) to facilitate sliding movement of the keeper 562 within the base 540. Although not shown, the base 540 may have a longitudinal channel cooperatively dimensioned with the curved front and rear walls 565, 567 to guide the movement of the keeper 562. Referring to FIGS. 16 and 17, each finger 562 is positioned with a finger slot 568. Preferably, the finger 562 is recessed or positioned below an upper edge 568*a* of the slot 568 wherein a notch or step-down is formed between the upper edge 568*a* and an upper portion of the finger 562. The finger 562 has a main portion 562*a* and a leading edge 562*b* that is received within the slot 34 of the plug 32 of the connector 20 in the secured position SP. The leading edge 562 can have a linear, curvilinear or jagged configuration for reception within the plug slot 534. The keeper 560 further includes a central slot 570 that receives the fastener 547.

In operation, the keeper 560 slidingly moves within the cavity 550 of the base 540. When the operator brings the object 14 close to the apparatus 10 such that the connector plug 32 extends into the aperture 548, the finger 562 is received within the plug slot 534 to arrive at the secured position SP. To bring the apparatus 510 to the released position RP, an inwardly directed releasing force F3 is applied to the actuator 582. The release force F3 causes the keeper 560 to move inward of the cavity 550 and towards the first wall 542, thereby compressing the spring 586. This movement disengages the keeper finger 562 from the plug slot 534 to arrive at the released position RP. As the object 14 and the connector 20 are elevated from the base 540 to reach the detached position DP, the plug 32 exits the aperture 548. Since the finger 562 is disengaged or released from the slot 34, the finger 562 does not prevent removal of the plug 32. Because the connector 20 and the plug 32 remain stationary and the keeper 560 is displaced, the keeper slot 568 is dimensioned to accommodate sliding movement of the keeper 560 about the plug 32. Similarly, the central slot 570 is dimensioned to accommodate sliding movement of the keeper 560 about the fastener 547.

Figure 19:
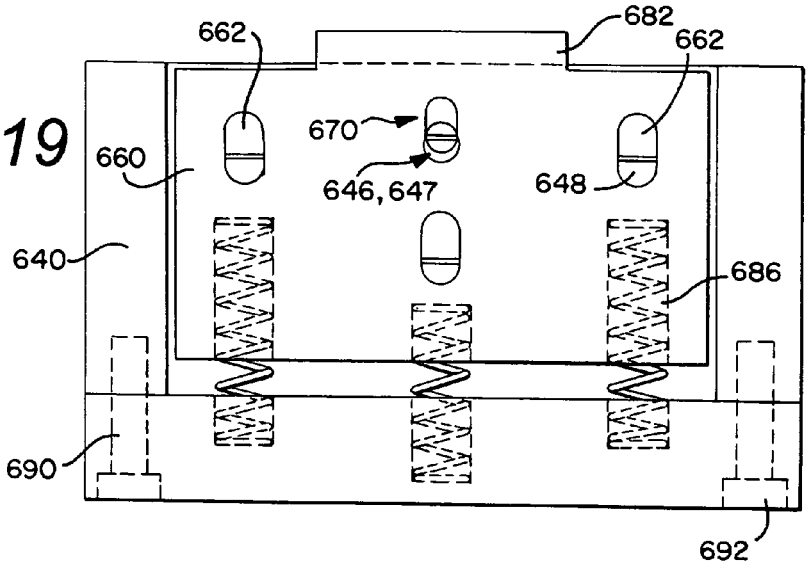
FIG. 19 is a top plan view of an alternate coupler apparatus, showing hidden structure in broken lines.
Figure 20:
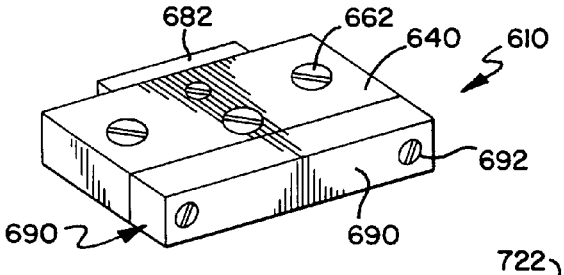
FIG. 20 is a perspective view of the coupler apparatus of FIG. 19.

FIGS. 19 and 20 show an additional alternate quick-release coupler 610. The apparatus 610 includes a base 610, a keeper 660 with integrated actuator 682 and a retension plate 690 that is removably secured to the base 640 with at least fastener 692. The base 640 includes three apertures 648 and the keeper 660 includes three fingers 662. Three springs 686 are positioned between the keeper 660 and the retension plate 690 for biasing of the keeper 660. Preferably, the three springs 686 are of equal length and are inline with the fingers 662 to equalize the biasing force and the locking force provided by the keeper 660. As explained above, the base 640 includes an opening 646 through which a fastener 647 extends. The fastener 647 extends through the base 640 and the keeper 660. The base 640 further includes at least one aperture 648, which is preferably tapered in a manner consistent with the aperture 48 explained above. The keeper 60 further includes a central slot 670 that receives the fastener 647. Since the connector 20 and the plug 32 remain stationary and the keeper 660 is displaced, the keeper slot 670 is dimensioned to accommodate sliding movement of the keeper 660 about the plug 32.

Figure 22:
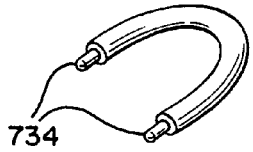
FIG. 22 is a perspective view of an alternative connector.
Figure 21:
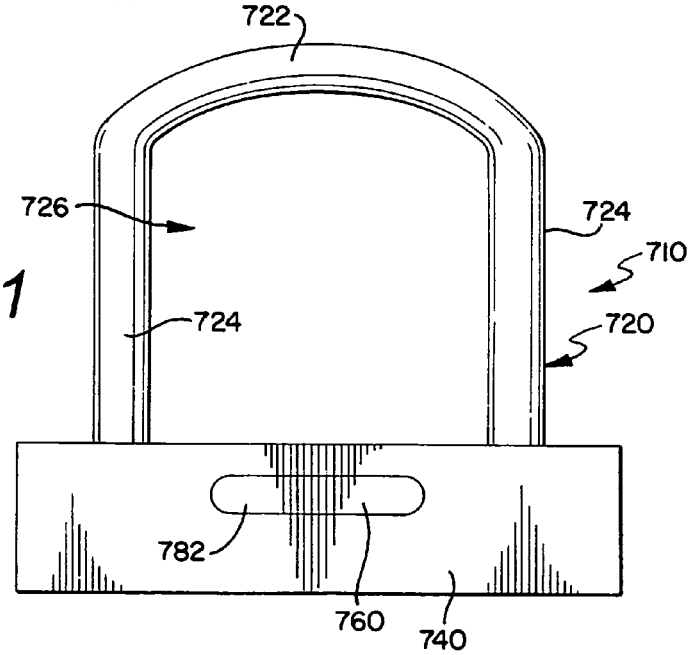
FIG. 21 is a perspective view of an alternate coupler apparatus, showing a curvilinear connector.

FIGS. 21 and 22 show another quick-release coupler 710 that includes a base 740, a keeper 760 with an actuator 782 and a curvilinear connector 720. The connector 720 has a central portion 722 and peripheral portions 724 that extend from each end of the central portion 722. Preferably, the peripheral portions 724 are linear whereby the connector 720 is U-shaped and a central region 726 is formed between the base 740 and the connector 720. Each leg or peripheral portion 724 includes a plug 734 that is structured similar to that explained above. Furthermore, the locking interaction between the plug 734 and the base 740 is consistent with that explained above. The connector 720 and/or the base 740 may be integrated or releasably connected to the object 14 and the support structure 18, respectively. The base 740 may include a pivoting or rotating locking member that prevents unexpected detachment of the connector 720.

In another embodiment, the coupler 10 is configured as a workpiece holder apparatus 10 for a machine tool that provides for rapid interchangeability of the workpiece S, such as the elongated body in FIG. 2. Consistent with that explained above, the workpiece holder 10 includes a fixture 20 that secures the workpiece and a base 40. The fixture or coupler 20 and the workpiece S are vertically detached from the base 40 without pivoting or rotation, whereby the workpiece S can be connected to another base 40 installed on/in other machine tools or tool stations. As explained, the mounting apparatus 10 includes unique components that enable the workpiece S, for example an electrode, to be moved between the secured position SP, the released position RP and the detached position DP wherein the workpiece is removed from the base 40 by the application of a vertical lifting force upon the fixture 20 and/or the workpiece. Once the detached position DP is reached, the workpiece S can be moved to a base installed in a different tool and/or tool station without recalibrating the positioning of the workpiece. In this manner, the apparatus 10 allows for the rapid and precise interchangeability of workpieces and the movement of workpieces S between various tools.

The fixture 20 is connected to the workpiece S and includes structure that is received by the base 40 to removably secure the workpiece S to the base 40, which is installed to a tool. As shown in FIG. 1, the fixture 20 is a ring assembly 21 that includes an upper ring segment 22 and a lower ring segment 24. The upper and lower rings segments 22, 24 are joined with a fastener 26 to define a receiver 28 that securedly receives a portion of the workpiece. Preferably, the fastener 26 extends through a flange portion 25 of the ring segments 22, 24. Although shown as having a circular periphery, the receiver 28 can have other configurations to engage the workpiece S. For example, the receiver 28 can have a U-shaped or V-shaped configuration to cradle an extent of the workpiece. Alternate configurations of the fixture 20 are shown in FIGS. 1A-L. A liner 29 can be positioned within the receiver 28 to minimize the chance that the ring segment 22, 24 scratches the exterior surface of the workpiece.

Figure 23:
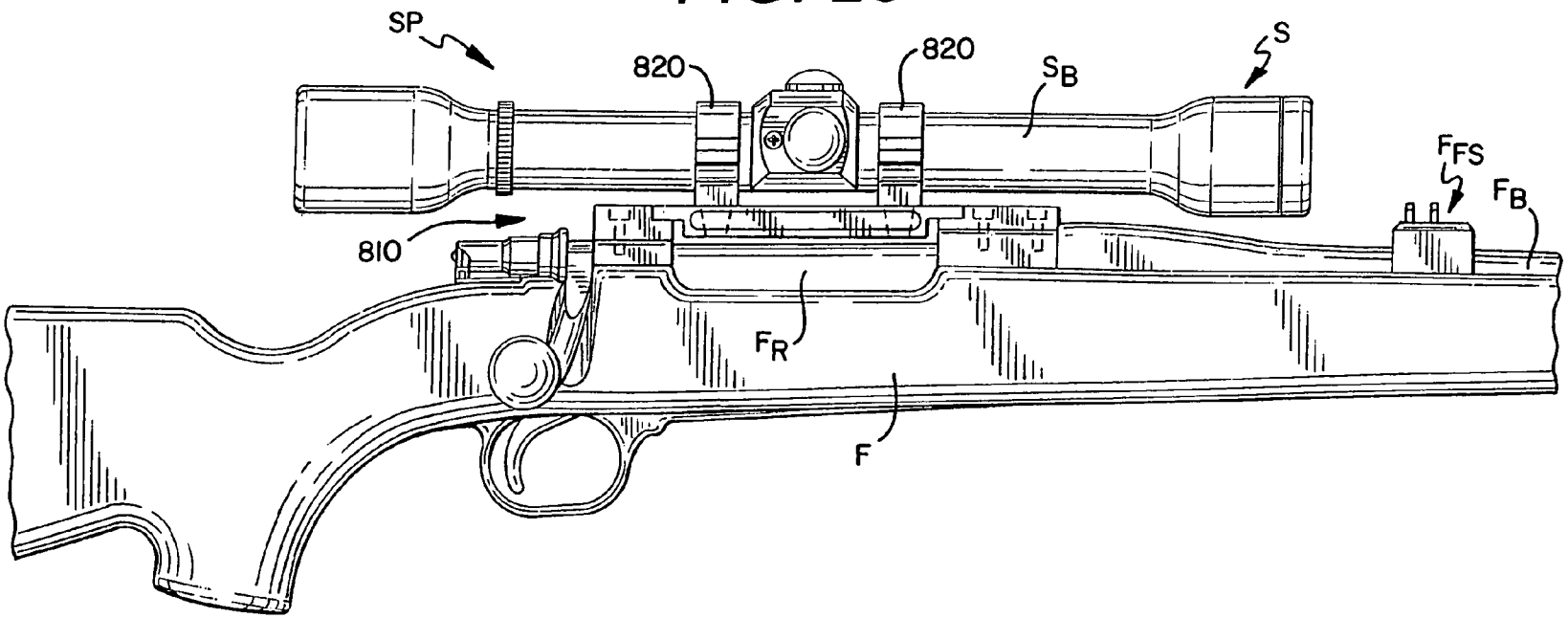
FIG. 23 is a perspective view of an alternate embodiment of the coupler configured as a firearm accessory mounting apparatus; and, FIG. 24 is a side view of the firearm accessory mounting apparatus of FIG. 23, showing the accessory, a optical scope, in a detached position.
Figure 24:
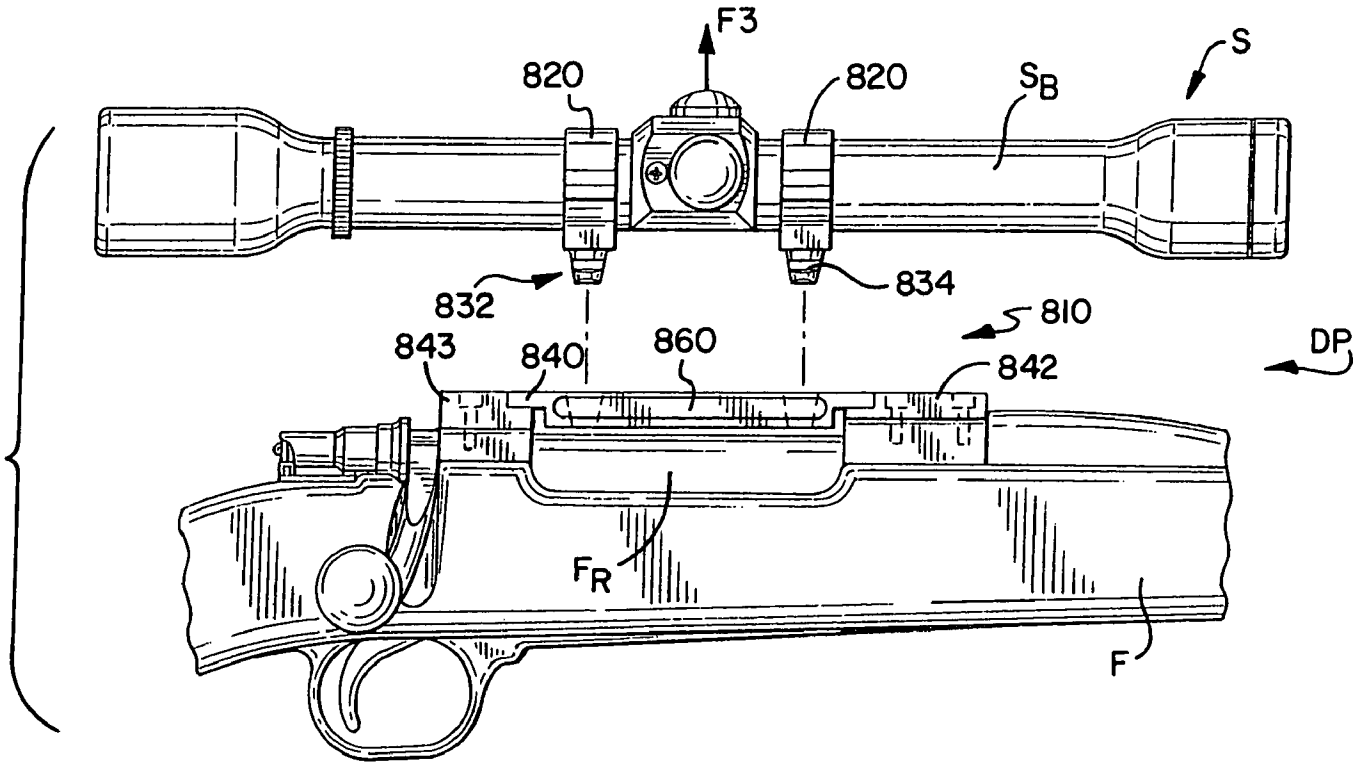

In yet another embodiment shown primarily in FIGS. 23 and 24, the coupler 10 is configured as firearm accessory mounting apparatus 810 of the invention. The mounting apparatus 810 is configured to removably secure an accessory, such as an optical scope S, a laser or laser aiming module (LAM), a flashlight, a range finder, or a night vision scope to a firearm F. As explained below, the mounting apparatus 810 includes unique components that enable the accessory, for example the scope S, to be moved between a secured position SP (see FIG. 23) wherein the scope S is secured to the firearm F, a released position RP, and a detached position DP (see FIG. 24) wherein the scope S is removed from the firearm F by the application of a vertical lifting force upon the scope S. Once the detached position DP is reached, a second scope S or a different accessory, such as a flashlight, can be affixed to the firearm F without recalibrating the mounting apparatus 810 and/or the firearm F from the initial calibrations made for the first scope S. In this manner, the apparatus 810 allows for the rapid and precise interchangeability of various accessories to the firearm F without compromising the operation and accuracy of the firearm F. Where scopes and other optical devices are the interchanged accessories, the apparatus 810 provides optical zero for each accessory thereby eliminating the time consuming steps of adjusting the firearm and/or the accessory sights for windage and elevation to reach optical zero. One of skill in the art recognizes that optical zero results from the sighting process where the sights are adjusted to account for windage and elevation. In contrast to conventional devices, the accessory is moved to the detached position DP with a purely vertical movement that does not require pivoting of the scope S, or the actuation of a rotary knob or levers to detach the scope S from the firearm F. In further contrast with conventional devices, when the accessory, such as the scope S is detached, the shooter can still utilize the firearm's front sights $F_{FS}$ (see FIG. 23) that extend upward from the firearm barrel $F_B$ to aim the firearm F before firing a round. Consistent with the components of the coupler 10, the mounting apparatus 810 comprises at least one accessory coupler 820, a base 840, a keeper 860, and a release assembly 880.

As shown in FIGS. 23 and 24, the base 840 is an elongated support structure that is affixed to the firearm frame $F_F$ by a front mounting tab 842 and a rear mounting tab 843. The base 840 includes the upper surface 840*a* and a main body portion 40*b*. Referring to FIG. 4, at least one fastener 844 secures the mounting tabs 842, 843 to the frame $F_F$ such that the base 840 is positioned above the firearm receiver $F_R$. Due to the configuration of the mounting apparatus 810, including the base 840 and the tabs 842, 843, the operation of the firearm F is not compromised, including the ejection of a shell or casing from the firearm receiver $F_R$. In another configuration, the tab 843 has a concave bottom wall with a centrally positioned rail. This configuration is particularly suited for mounting the tab 843 and the apparatus 810 to a shotgun. In another alternative mounting configuration, the base 840 via the tabs 842, 843 is secured to an extent of the barrel $F_B$ near the muzzle, which results in a "scout mount." In yet another mounting configuration, the base 840 includes an elongated extension arm that provides a "cantilever mount" for the accessory S with respect to the firearm F.

Referring to FIGS. 23 and 24, the tabs 842, 843 are configured such that when the accessory S is removed, the tabs 842, 843 do not obstruct the shooter from aiming the firearm via the front sights $F_{FS}$ and firing a round. Accordingly, the tabs 842, 843 have a height such that when affixed to the firearm F, neither tab 842, 843 extends above the front sights $F_{FS}$. In one embodiment, the front tab 842 has a height of less than 0.5 inch and the rear tab 843 has a height of less than 0.7 inch. In a preferred embodiment where the apparatus 810 is used in connection with a bolt action rifle, the front tab 842 has a height of less than 0.35 inch and the rear tab 843 has a height of less than 0.55 inch.

To remove the accessory and arrive at the detached position DP from the released position RP, an upward detaching force F3 is applied to the accessory and/or the coupler(s) 820. Referring to FIG. 24, the detaching force F3 is a vertical force applied to the scope S whereby the plugs 834 are detached from the aperture 848 and the base 840. Preferably, the detaching force F3 is applied substantially perpendicular to the base 840 and the firearm F. Described in a different manner, the detaching force F3 is applied substantially parallel to a longitudinal axis of the aperture 848. Unlike conventional accessory mounting devices which require pivoting or rotation of the accessory for removal that leads to contact between the accessory and the firearm F, the inventive apparatus 810 provides for vertical detachment that prevents the accessory from contacting the firearm F. The contact necessitated by conventional mounting devices is problematic because such contact can damage the accessory and/or limit the configuration or size of the accessory to be mounted to the firearm F. For example and with a conventional mounting device that requires accessory pivoting for removal, the diameter of the front and rear bells of a scope S is limited since the bells will make contact with the firearm F during removal. If the either of the bells are too large, the removal process will be hindered or precluded with conventional mounting devices. Because the present apparatus 10 provides for vertical detachment and no rotation or pivotal movement, the dimensions of the accessory, including the bells of the scope S, are not limited. An operator or shooter can apply the releasing force F2 and the detaching force F3 with one hand. For example, the shooter can apply the releasing force F2 with his thumb and then grasp the accessory to provide the detaching force F3 while using his other hand to steady the firearm F.

While the specific embodiments have been illustrated and described, numerous modifications come to mind without significantly departing from the spirit of the invention, and the scope of protection is only limited by the scope of the accompanying Claims.

What is claimed is:

1. A quick-release and attachment coupler for automatically releasing and securing two objects to one another, the coupler comprising:

a connector having a conical tapered plug extending from a main body portion, the plug having a slot that extends inward from an outer wall of the plug;

a base having an internal cavity extending between opposed side walls, an aperture with an internal wall including an orifice, the aperture being cooperatively dimensioned with the plug for reception;

a keeper slidably positioned within the internal cavity of the base, the having a finger with a leading portion having an inclined upper surface that engages a bottom surface of the plug upon insertion of the plug into the aperture retracting the finger until the leading portion aligns with and extends through the orifice engaging the slot to retain the plug within the aperture automatically coupling the connector and the base without pivoting or rotation; and, a pushbutton release comprising an actuator operably connected to the keeper, wherein movement of the actuator displaces the leading portion of the finger from the slot permitting removal of the plug from the aperture and the connector from the base in a single linear motion without pivoting or rotation.

2. The coupler of claim 1, wherein the release includes a means for biasing the actuator, the biasing means positioned between the actuator and an internal wall of the base.

3. The coupler of claim 1, wherein the plug has an upper portion having a diameter greater than a diameter of the lower portion.

4. The coupler of claim 3, wherein the aperture has an upper portion and a lower portion, wherein the upper portion has a diameter greater than the lower portion.

5. The coupler of claim 1, wherein the aperture extends between an upper wall of the base and a lower wall of the base.

6. The coupler of claim 1, wherein the connector includes an upper ring segment and a lower ring segment that collectively define a receiver for engaging an outer surface of the object.

7. The coupler of claim 1, wherein the keeper and the finger move in a direction substantially perpendicular to a longitudinal axis of the plug.

8. The coupler of claim 1, wherein the base is integrated in the support structure.

9. The coupler of claim 1, wherein the connector attaches to a first object and the base attaches to a second object prior to attachment of the first object to the second object.

10. A quick-release and attachment coupler for releasably securing two objects to one another, the coupler comprising:

a connector attachable to a first object, the connector comprising:

a first tapered plug extending from a main body portion and having a slot that extends inward from an outer wall of the plug; and, a second tapered plug identical to the first tapered plug extending from the main body portion and having a slot that extends inward from an outer wall of the plug;

a base attachable to a second object, the base comprising:

an internal cavity extending between opposed side walls;

a first aperture with an internal wall arrangement including an orifice, the aperture being cooperatively dimensioned with the first plug for reception of the plug within the aperture;

a second aperture with an internal wall arrangement including an orifice, the aperture being cooperatively dimensioned with the second plug for reception of the plug within the aperture;

a keeper slidably positioned within the internal cavity, the keeper having a first finger with a leading portion that extends through the orifice and into the slot of the first plug to retain the first plug within the first aperture and a second finger with a leading portion that extends through the orifice and into the slot of the second plug to retain the second plug within the second aperture, wherein simultaneous insertion of the first and second plugs into the first and second apertures retract the fingers until the leading portion aligns with and engages the respective slots through the orifice automatically coupling the connector to the base without pivoting or rotation; and, a biased pushbutton release operably connected to the keeper, wherein the movement of the release simultaneously displaces the first finger and the second finger from the respective slots of the plugs permitting substantially only vertical lift of the connector from the base.

11. An automatic quick-release coupler for securing and releasing two objects to one another, the coupler comprising:

a connector having a conical tapered plug extending from a main body portion, the plug having a slot that extends inward from an outer wall of the plug;

a base having an internal cavity extending between opposed side walls, an aperture with an internal wall including an orifice, the aperture being cooperatively dimensioned with the plug, wherein insertion of the plug into the aperture automatically connects the connector and the base without pivoting or rotation;

a keeper slidably positioned within the internal cavity of the base, the keeper having a finger with a leading portion having an inclined upper surface that engages a bottom surface of the plug upon insertion of the plug into the aperture retracting the finger until the leading portion aligns with and extends through the orifice engaging the slot to retain the plug within the aperture automatically coupling the connector and the base without pivoting or rotation;

a pushbutton release operably connected to the keeper, the release including a biasing actuator, wherein movement of the actuator displaces the leading portion of the finger from the slot simultaneously permitting the plug to be removed from the aperture and the connector from the base in a single linear motion without pivoting or rotation.

* * * * *